US012742308B2

(12) United States Patent
Nakano et al.

(10) Patent No.: US 12,742,308 B2
(45) Date of Patent: Sep. 22, 2026

(54) SYSTEM AND METHOD FOR CONTROLLING WORK MACHINE

(71) Applicant: KOMATSU LTD., Tokyo (JP)

(72) Inventors: Kei Nakano, Tokyo (JP); Souichi Tsumura, Tokyo (JP); Osamu Shimizu, Tokyo (JP); Tomoki Ando, Tokyo (JP)

(73) Assignee: KOMATSU LTD., Tokyo (JP)

( * ) Notice: Subject to any disclaimer, the term of this patent is extended or adjusted under 35 U.S.C. 154(b) by 16 days.

(21) Appl. No.: 18/854,687

(22) PCT Filed: Jun. 21, 2023

(86) PCT No.: PCT/JP2023/022868

§ 371 (c)(1),
(2) Date: Oct. 7, 2024

(87) PCT Pub. No.: WO2024/014238

PCT Pub. Date: Jan. 18, 2024

(65) Prior Publication Data

US 2025/0230632 A1 Jul. 17, 2025

(30) Foreign Application Priority Data

Jul. 14, 2022 (JP) ..... 2022-112996

(51) Int. Cl.
*E02F 9/20* (2006.01)
*E02F 9/26* (2006.01)

(52) U.S. Cl.
CPC ..... *E02F 9/205* (2013.01); *E02F 9/2041* (2013.01); *E02F 9/262* (2013.01); *E02F 9/265* (2013.01)

(58) Field of Classification Search
CPC ..... E02F 9/205; E02F 9/2041; E02F 9/262; E02F 9/265; E02F 9/2045; E02F 9/2054; E02F 9/20; G05D 1/43
(Continued)

(56) References Cited

U.S. PATENT DOCUMENTS

2022/0002966 A1 1/2022 Takaoka
2022/0010533 A1 1/2022 Takaoka
(Continued)

FOREIGN PATENT DOCUMENTS

JP 2020-166302 A 10/2020
JP 2020-166303 A 10/2020
(Continued)

OTHER PUBLICATIONS

International Search Report for the corresponding international patent application No. PCT/JP2023/022868, issued on Sep. 5, 2023.
(Continued)

*Primary Examiner* — Maceeh Anwari
(74) *Attorney, Agent, or Firm* — Spencer Fane LLP

(57) ABSTRACT

A system includes a machine position sensor and a controller. The machine position sensor outputs current position data indicative of the position of the work machine. The controller acquires actual topography data including the position of a first slot extending in a predetermined work direction, the position of a second slot positioned beside the first slot, and the position of a first excavation wall positioned between the first slot and the second slot. The controller determines a first excavation path extending from the first slot to a first position on the second slot and cuts across the first excavation wall. The controller determines a transportation path extending from a position behind the first position in the work direction, along the second slot, and toward a predetermined soil unloading position. The controller controls the work machine to move according to the first excavation path and the transportation path.

20 Claims, 28 Drawing Sheets

(58) Field of Classification Search
USPC ..... 701/50
See application file for complete search history.

(56) References Cited

U.S. PATENT DOCUMENTS

| | | | |
|---|---|---|---|
| 2022/0389679 | A1 | 12/2022 | Hirayama |
| 2024/0026646 | A1 | 1/2024 | Kadono |

FOREIGN PATENT DOCUMENTS

| | | | | |
|---|---|---|---|---|
| JP | 2021-105258 | A | 7/2021 | |
| WO | 2021/131645 | A1 | 7/2021 | |
| WO | WO-2022130756 | A1 * | 6/2022 | ..... E02F 9/2054 |

OTHER PUBLICATIONS

Bigshow, Oxbow, "The lost art of slot dozing!", Heavy Equipment Forums, https://www.heavyequipmentforums.com/threads/the-lost-art-of-slot-dozing.40238/ Dec. 8, 2013.
Stewart, "Maximize Dozer Operations", constructionequipment.com, https://www.constructionequipment.com/earthmoving/crawler-dozers/article/10708666/maximize-dozer-operations Sep. 28, 2010.
First Office Action for the corresponding Canadian Patent Application No. 3,254,911; issued Feb. 3, 2026.

* cited by examiner

SYSTEM AND METHOD FOR CONTROLLING WORK MACHINE

CROSS-REFERENCE TO RELATED APPLICATIONS

This application is a U.S. National stage application of International Application No. PCT/JP2023/022868, filed on Jun. 21, 2023. This U.S. National stage application claims priority under 35 U.S.C. § 119(a) to Japanese Patent Application No. 2022-112996, filed in Japan on Jul. 14, 2022, the entire contents of which are hereby incorporated herein by reference.

BACKGROUND

The present disclosure relates to a system and a method for controlling a work machine.

BACKGROUND INFORMATION

Slot dozing is work performed by a work machine. In slot dozing, the actual topography of a work site is excavated by a work implement whereby a plurality of slots are formed in the actual topography. Moreover, excavation walls are formed between the plurality of slots. The excavation walls are piles of soil (windrows) left over along the slots.

International Publication WO 2021-131645 describes a control of a work machine for excavating and removing the excavation walls. For example, a controller determines a work path for removing the excavation wall between a first slot and a second slot. The work path includes an excavation path, a soil carrying path, and a reverse path. The excavation path extends from the start position on the first slot to a position on the second slot and cuts across the excavation wall. The soil carrying path extends from the excavation path to a soil unloading position. The reverse path extends from the soil unloading position to the next start position on the second slot. The controller causes the work machine to move according to the work path thereby excavating the excavation wall.

SUMMARY

The work machine holds the soil excavated from the excavation wall by moving from the first slot toward the second slot according to the excavation path. The work machine changes the direction on the second slot while carrying the soil and moves according to the soil carrying path. As a result, the work machine turns while carrying the soil and a heavy load is applied to the work machine. Furthermore, soil falls off of the work machine as a result of the turning and the quality of the finish of the work is decreased. An object of the present disclosure is to reduce the load on the work machine and improve the quality of the finish of the work in work for removing an excavation wall.

A system according to a first embodiment of the present disclosure is a system for controlling a work machine. The system includes a machine position sensor and a controller: The machine position sensor outputs current position data that indicates the position of the work machine. The controller acquires the current position data. The controller acquires actual topography data. The actual topography data includes the position of a first slot that extends in a predetermined work direction, the position of a second slot that is positioned beside the first slot, and the position of a first excavation wall that is positioned between the first slot and the second slot. The controller determines a first excavation path. The first excavation path extends from the first slot to a first position on the second slot and cuts across the first excavation wall. The controller determines a transportation path. The transportation path extends from a position behind the first position in the work direction, along the second slot, and toward a predetermined soil unloading position. The controller controls the work machine so as to move according to the first excavation path and the transportation path.

A method according to another embodiment of the present disclosure is a method for controlling a work machine. The method comprises acquiring current position data, acquiring actual topography data, determining a first excavation path, determining a transportation path, and controlling a work machine so as to move according to the first excavation path and the transportation path. The current position data represents the position of the work machine. The actual topography data includes the position of a first slot that extends in a predetermined work direction, the position of a second slot that is positioned beside the first slot, and the position of a first excavation wall that is positioned between the first slot and the second slot. The first excavation path extends from the first slot to a first position on the second slot and cuts across the first excavation wall. The transportation path extends from a position behind the first position in the work direction, along the second slot, and toward a predetermined soil unloading position.

According to the present disclosure, the work machine excavates the first excavation wall by moving to the first position according to the first excavation path. Thereafter, the work machine carries the soil excavated from the first excavation wall to the soil unloading position by moving according to the transportation path. The transportation path extends from a position behind the first position, along the second slot, and toward the soil unloading position. As a result, after placing the soil excavated from the first excavation wall on the first position, the work machine moves from the position behind the first position to the soil unloading position according to the transportation path. As a result, the work machine is able to change direction by turning while not carrying the soil. Consequently, the load on the work machine is reduced and the quality of the finish of the work is improved in the work for removing the first excavation wall.

DESCRIPTION OF EMBODIMENTS

Figure 1:
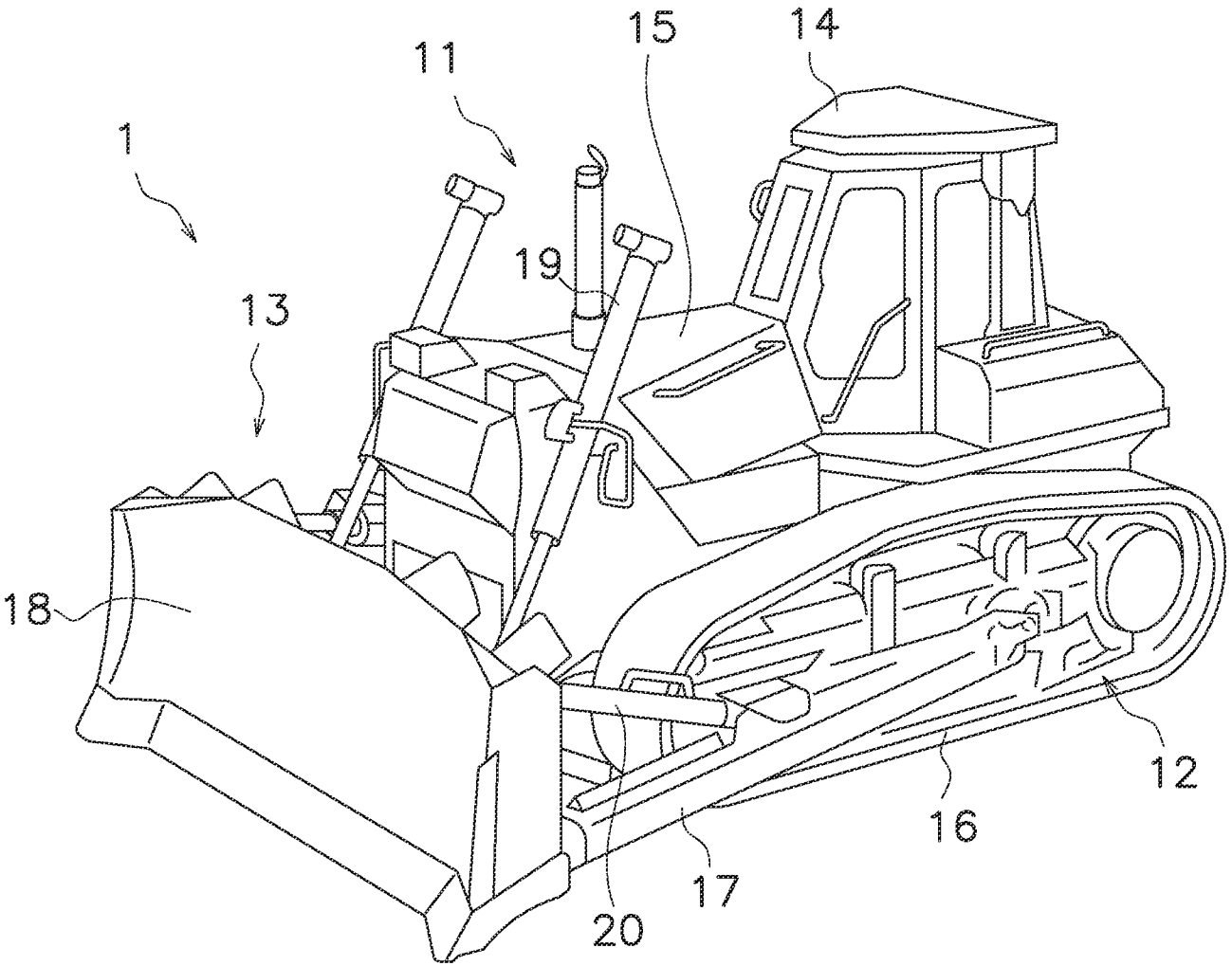
FIG. 1 is a side view of a work machine according to an embodiment.

A control system and a control method for a work machine 1 according to an embodiment are discussed hereinbelow with reference to the drawings. FIG. 1 is a side view of a work machine 1 according to the embodiment. The work machine 1 according to the present embodiment is a bulldozer. The work machine 1 includes a vehicle body 11, a travel device 12, and a work implement 13.

The vehicle body 11 includes an operating cabin 14 and a power compartment 15. An operator's seat that is not illustrated is disposed inside the operating cabin 14. The power compartment 15 is disposed in front of the operating cabin 14. The travel device 12 is attached to a bottom part of the vehicle body 11. The travel device 12 includes a pair of left and right crawler belts 16. Only the crawler belt 16 on the left side is illustrated in FIG. 1. The work machine 1 travels due to the rotation of the crawler belts 16.

The work implement 13 is attached to the vehicle body 11. The work implement 13 includes lift frames 17, a blade 18, lift cylinders 19, and tilt cylinders 20. The lift frames 17 are attached to the vehicle body 11 in a manner that allows movement up and down. The lift frames 17 support the blade 18.

The blade 18 is disposed in front of the vehicle body 11. The blade 18 moves up and down accompanying the up and down movements of the lift frames 17. The lift cylinders 19 are coupled to the vehicle body 11 and the blade 18. Due to the extension and contraction of the lift cylinders 19, the lift frame 17 moves up and down. The tilt cylinders 20 are respectively coupled to the lift frames 17 and the blade 18. The left and right ends of the blade 18 perform a tilting motion vertically due to the extension and contraction of the tilt cylinders 20.

Figure 2:
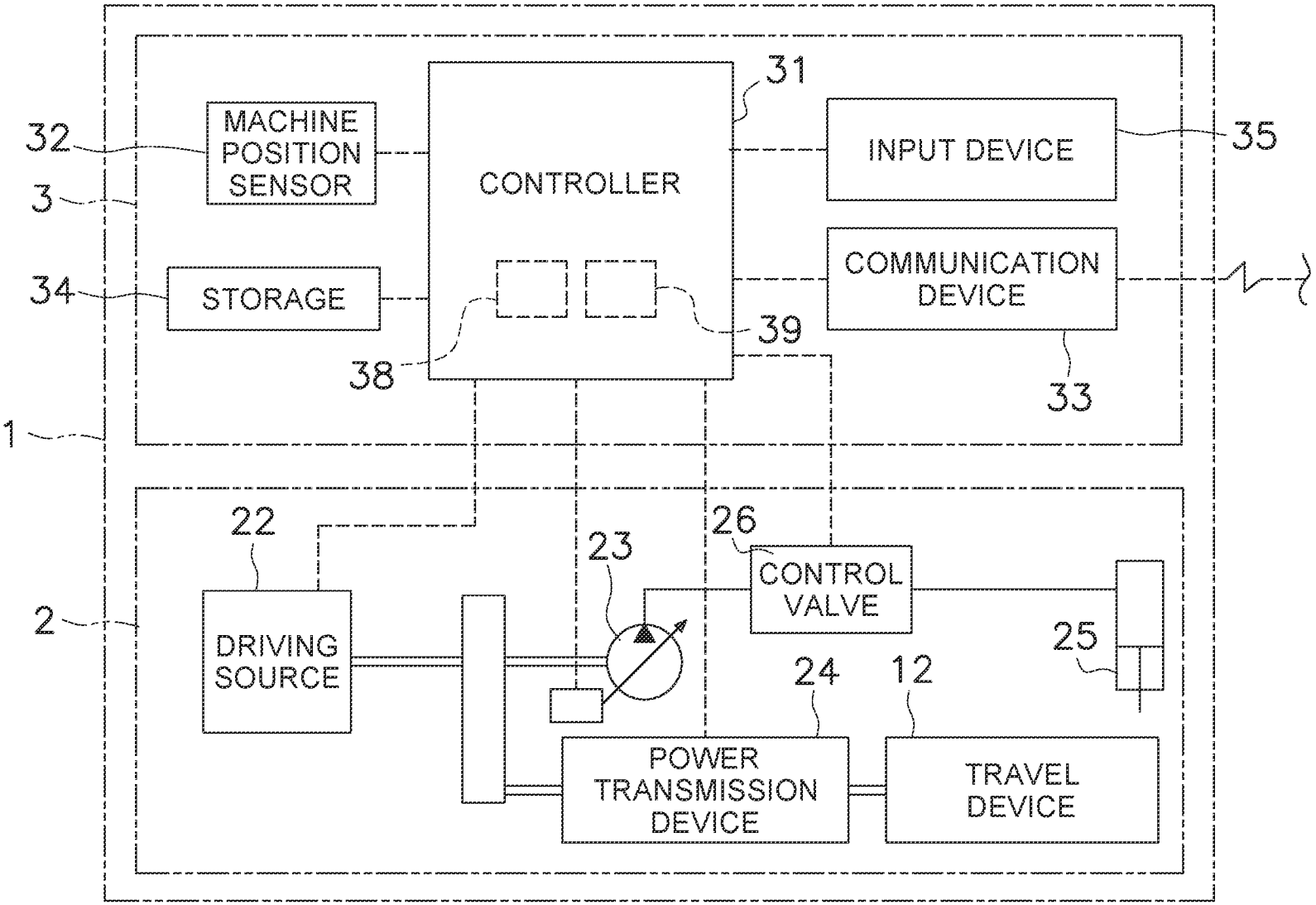
FIG. 2 is a block diagram illustrating configurations of a drive system and a control system of the work machine.

FIG. 2 is a block diagram illustrating configurations of a drive system 2 and a control system 3 of the work machine 1. As illustrated in FIG. 2, the drive system 2 includes a driving source 22, a hydraulic pump 23, and a power transmission device 24.

The driving source 22 includes, for example, an internal combustion engine. Alternatively, the driving source 22 may also include an electric motor. The hydraulic pump 23 is driven by the driving source 22 and discharges hydraulic fluid. The hydraulic fluid discharged from the hydraulic pump 23 is supplied to a hydraulic actuator 25. For example, the hydraulic actuator 25 includes the above-mentioned lift cylinders 19 and the tilt cylinders 20. While only one hydraulic pump 23 is illustrated in FIG. 2, a plurality of hydraulic pumps may be provided.

A control valve 26 is disposed between the hydraulic actuator 25 and the hydraulic pump 23. The control valve 26 is a proportional control valve and controls the flow rate of the hydraulic fluid supplied from the hydraulic pump 23 to the lift cylinders 19. The control valve 26 may be a pressure proportional control valve. Alternatively, the control valve 26 may be an electromagnetic proportional control valve.

The power transmission device 24 transmits the driving power of the driving source 22 to the travel device 12. The power transmission device 24, for example, may be a transmission having a torque converter or a plurality of speed change gears. Alternatively, the power transmission device 24 may be, for example, a power transmission device for another system, such as a hydrostatic transmission (HST).

The control system 3 includes a controller 31, a machine position sensor 32, a communication device 33, a storage 34, and an input device 35. The controller 31 is programmed to control the work machine 1 based on acquired data. The controller 31 includes a memory 38 and a processor 39. The memory 38 includes, for example, a random access memory (RAM) and a read-only memory (ROM). The storage 34 includes, for example, a semiconductor memory or a hard disk and the like. The memory 38 and the storage 34 record computer instructions and data for controlling the work machine 1.

The processor 39 is, for example, a CPU but may be another type of processor. The processor 39 executes processing for controlling the work machine 1 based on the computer instructions and data stored in the memory 38 or the storage 34. The communication device 33 is, for example, a module for wireless communication and communicates with equipment outside the work machine 1. The communication device 33 may use a mobile communication network. Alternatively, the communication device 33 may use a local area network (LAN) or another network such as the Internet.

The machine position sensor 32 detects the position of the work machine 1. The machine position sensor 32 is, for example, a global navigation satellite system (GNSS) receiver such as a global positioning system (GPS). The machine position sensor 32 is mounted on the vehicle body 11. Alternatively, the machine position sensor 32 may be mounted in another position, such as on the work implement 13. The controller 31 acquires current position data, which indicates the current position of the work machine 1, from the machine position sensor 32.

The input device 35 is operable by an operator. The input device 35 is, for example, a touchscreen. Alternatively, the input device 35 may be another operation member, such as a hardware key. The input device 35 receives an operation from the operator and outputs a signal indicating the operation of the operator to the controller 31.

The controller 31 outputs instruction signals to the driving source 22, the hydraulic pump 23, the power transmission device 24, and the control valve 26 thereby controlling said devices. For example, the controller 31 controls the displacement of the hydraulic pump 23 and the opening degree of the control valve 26 thereby actuating the hydraulic actuator 25. Consequently, the work implement 13 can be actuated.

The controller 31 controls the rotation speed of the driving source 22 and the power transmission device 24 thereby causing the work machine 1 to travel. For example, when the power transmission device 24 is an HST, the controller 31 controls the displacement of the hydraulic pump and the displacement of a hydraulic motor of the HST When the power transmission device 24 is a transmission having a plurality of speed change gears, the controller 31 controls actuators for gear shifting. In addition, the controller 31 controls the power transmission device 24 so as to bring about a speed difference between the left and right crawler belts 16, thereby causing the work machine 1 to turn.

Automatic control of the work machine 1 executed by the controller 31 will be explained next. The controller 31 controls the driving source 22 and the power transmission device 24 thereby causing the work machine 1 to travel automatically. In addition, the controller 31 controls the driving source 22, the hydraulic pump 23, and the control valve 26 thereby automatically controlling the work implement 13.

Figure 3:
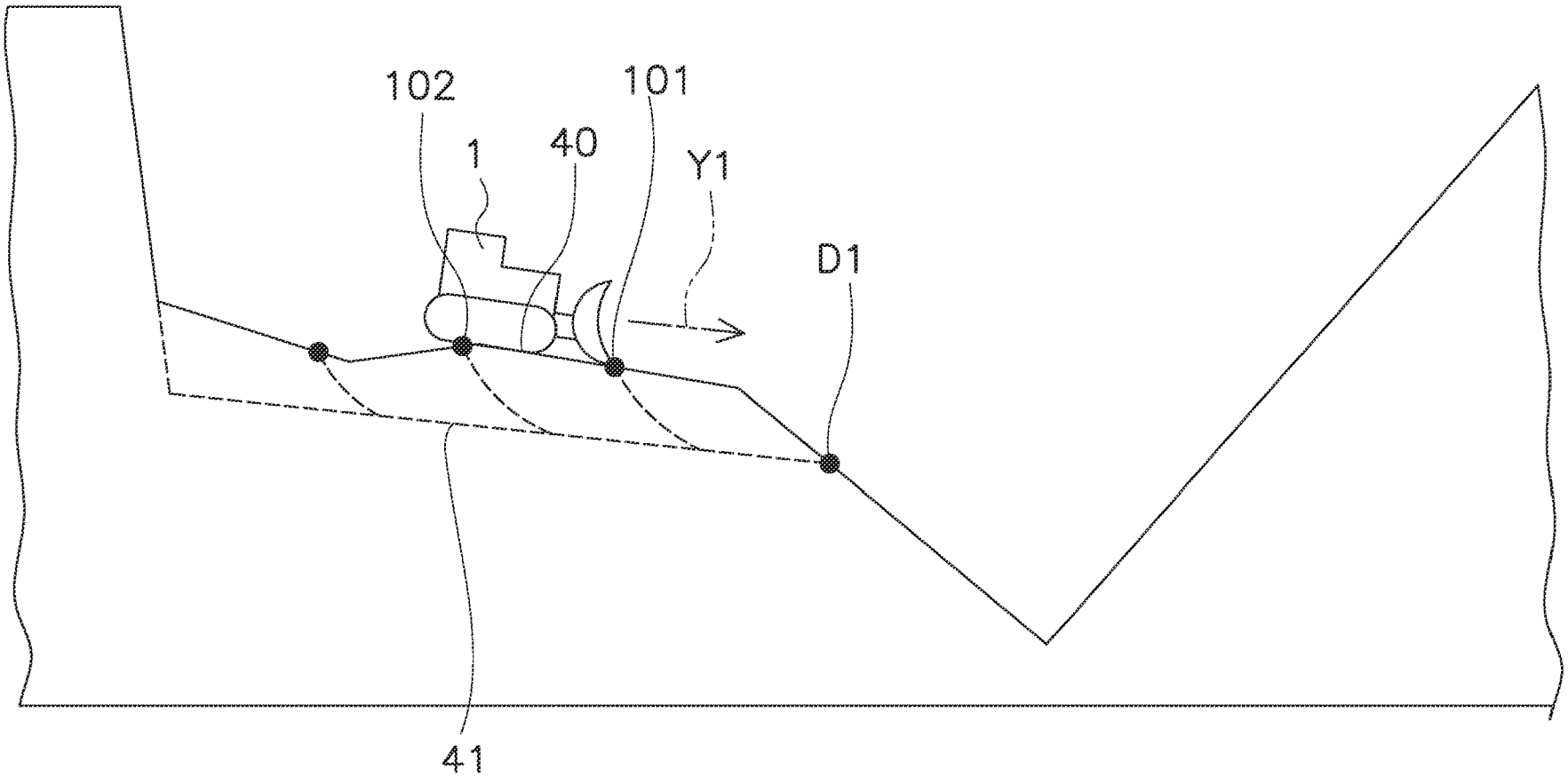
FIG. 3 is a side view of the actual topography of a work site.

FIG. 3 is a side view of an actual topography 40 of a work site. As illustrated in FIG. 3, the work machine 1 determines a target design surface 41. At least a portion of the target design surface 41 is located lower than the actual topography 40. The target design surface 41 extends in a predetermined first work direction Y1. The target design surface 41 may be previously determined and saved in the storage 34. The controller 31 may determine the target design topography 41 from the actual topography 40. Alternatively, the target design surface 41 may be input by an operator through the input device 35.

The controller 31 determines a starting position 101 for excavation on the actual topography 40. For example, the controller 31 may determine the starting position 101 based on the amount of soil to be excavated. The controller 31 controls the work machine 1 and causes the work machine 1 to move from the starting position 101 to a soil unloading position D1. Consequently, the actual topography 40 is excavated from the starting position 101 and the excavated earth and sand is carried to the soil unloading position D1. The controller 31 causes the work machine 1 to start to retreat when it has been determined that the work machine 1 has reached the soil unloading position D1.

The soil unloading position D1 may be at the end of the target design surface 41. The controller 31 may cause the work machine 1 to start to retreat when it has been determined that the work machine 1 has reached the end of the target design surface 41. The controller 31 may cause the work machine 1 to start to retreat when it has been determined that a height difference between the target design surface 41 and the work machine 1 is equal to or greater than a threshold before the work machine 1 reaches the end of the target design surface 41.

Figure 4:
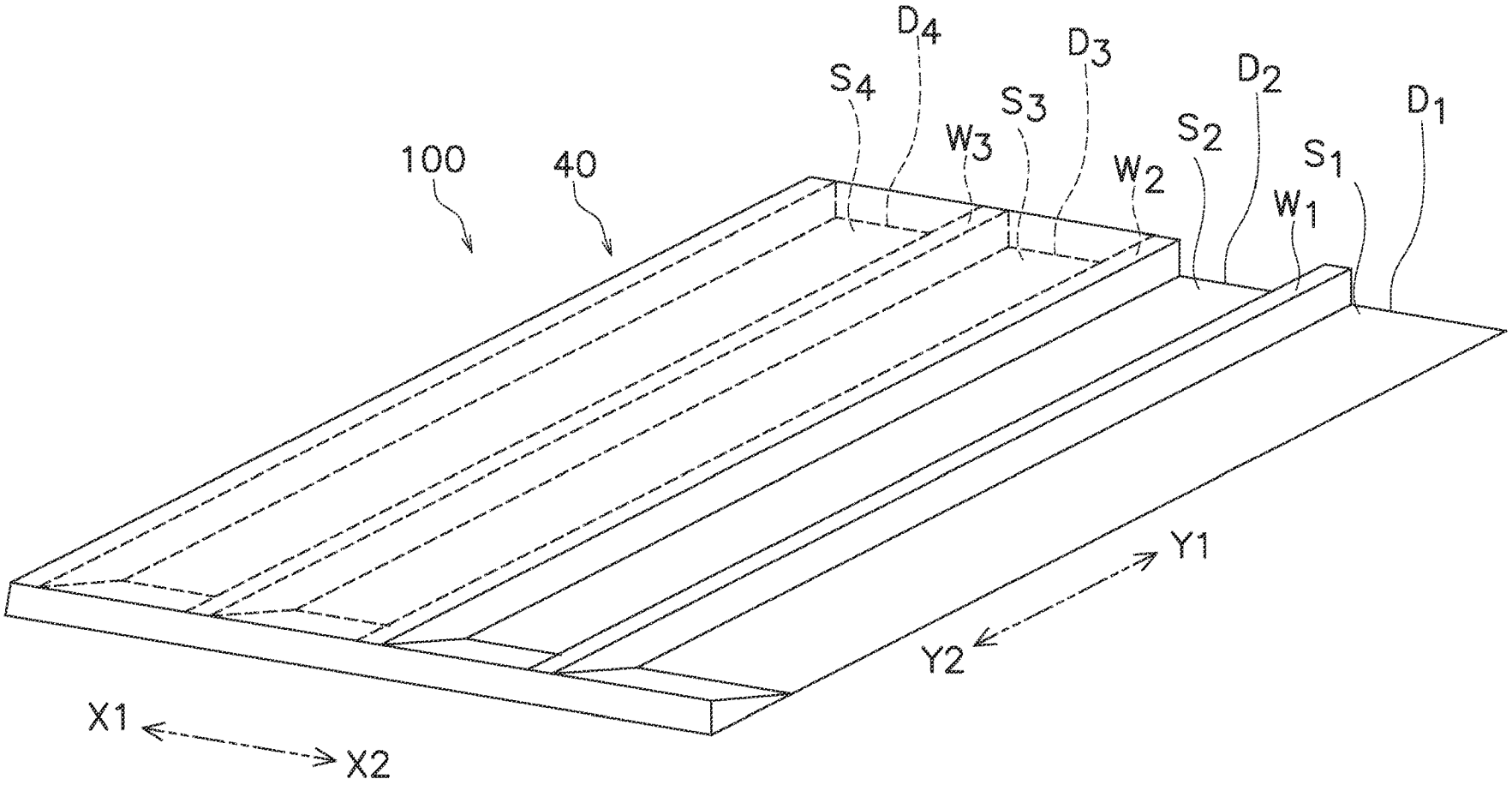
FIG. 4 is a perspective view illustrating an example of slots and excavation walls formed in the actual topography.

Next, the controller 31 causes the work machine 1 to move to the next starting position 102 that is positioned rearward of the previous starting position 101. The controller 31 then controls the work machine 1 and causes the work machine 1 to move from the starting position 102 to the soil unloading position D1. Consequently, the actual topography 40 is excavated from the starting position 102 and the excavated earth and sand is carried to the soil unloading position D1. By repeating the actions as described above, a first slot S1 that extends in the first work direction Y1 is formed in the actual topography 40 as illustrated in FIG. 4. The control for generating the first slot S1 is not limited to the above and may be changed.

The controller 31 controls the work machine 1 to form a plurality of slots S1 and S2 in order on the actual topography 40. The plurality of slots S1 and S2 are aligned side by side in the transverse directions X1 and X2. The transverse directions X1 and X2 are directions that cross the first work direction Y1. The plurality of slots S1 and S2 are arranged with an interval therebetween. As a result, an excavation wall W1 is formed between the plurality of slots S1 and S2. Similarly, an excavation wall W2 is formed between the slots S2 and S3 and an excavation wall W3 is formed between the slots S3 and S4. Because the excavation walls W1 to W3 are formed, the overflow of soil from the side of the blade 18 can be suppressed and furthermore the effect of stable linear progression is obtained. The following is an explanation of the automatic control of the excavation work of the excavation walls W1 to W3 performed by the work machine 1 at the work site.

Figure 5:
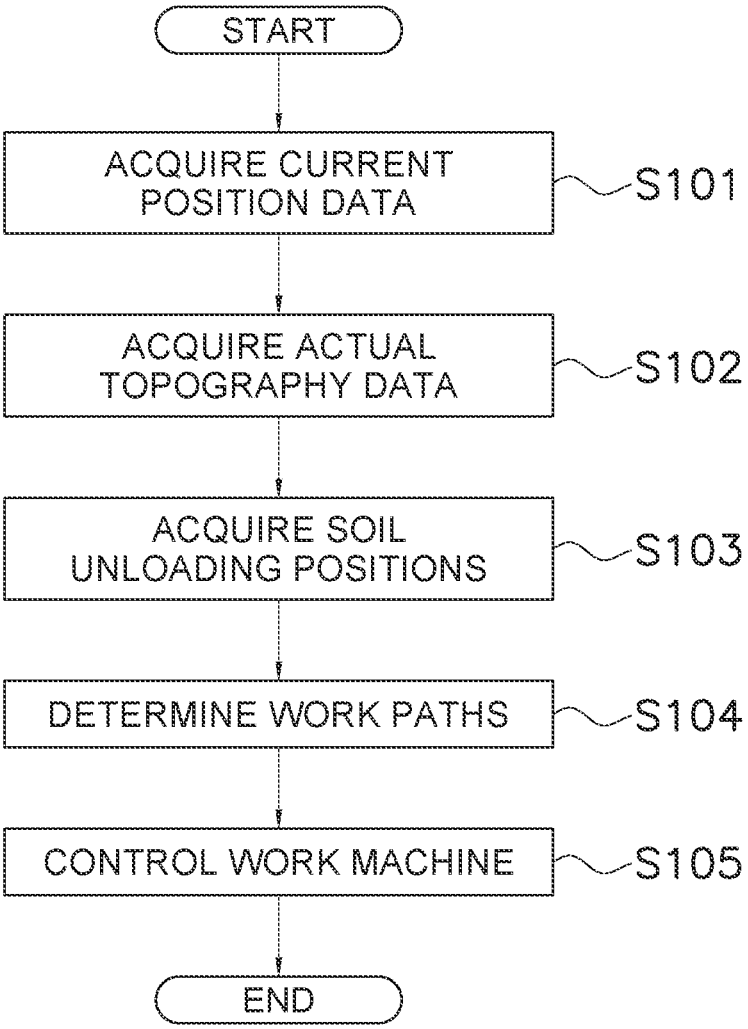
FIG. 5 is a flow chart illustrating automatic control processing of the work machine.

FIG. 5 is a flow chart illustrating automatic control processing of the work machine 1. As illustrated in FIG. 5, the controller 31 acquires the current position data in step S101. The controller 31 acquires the current position data from the machine position sensor 32.

In step S102, the controller 31 acquires the actual topography data. The actual topography data represents the actual topography 40 of the work site. For example, the actual topography data includes planar coordinates and the heights of the surface of the actual topography. The actual topography data includes the above-mentioned positions of the slots S1 to S4 and the positions of the excavation walls W1 to W3.

As illustrated in FIG. 4, the controller 31 excavates the excavation walls W1 to W3 in a work range 100 of the work site. The work range 100 is determined in advance and stored in the storage 34. Alternatively, the work range 100 may be determined automatically by the controller 31. Alternatively, the work range 100 may be input by an operator through the input device 35.

In the example illustrated in FIG. 4, the actual topography 40 in the work range 100 includes first to fourth slots S1 to S4. The first to fourth slots S1 to S4 extend in the first work direction Y1. The first to fourth slots S1 to S4 are aligned side by side in the transverse directions X1 and X2. The first to fourth slots S1 to S4 are arranged with intervals therebetween. The actual topography 40 in the work range 100 includes first to third excavation walls W1 to W3. The first excavation wall W1 is positioned between the first slot S1 and the second slot S2. The second excavation wall W2 is positioned between the second slot S2 and the third slot S3. The third excavation wall W3 is positioned between the third slot S3 and the fourth slot S4. The first to third excavation walls W1 to W3 extend in the first work direction Y1.

The actual topography data may be previously stored in the storage 34. The controller 31 may acquire the actual topography data by recording the trajectory of the work implement 13 or the bottom of the travel device 12. Alternatively, the actual topography data may be acquired by measuring with a measurement apparatus, such as a laser imaging detection or ranging device (LIDAR) or a camera. The controller 31 may acquire the actual topography data from the measurement apparatus. The measurement apparatus may be mounted on the work machine 1. The measurement apparatus may be disposed outside of the work machine 1.

In step S103, the controller 31 acquires soil unloading positions D1 to D4. The soil unloading positions D1 to D4 are positioned in front of the slots S1 to S4 in the first work direction Y1. In the example illustrated in FIG. 6, the soil unloading positions D1 to D4 include first to fourth soil unloading positions D1 to D4. The first to fourth soil unloading positions D1 to D4 are respectively positioned in front of the first to fourth slots S1 to S4 in the first work direction Y1.

In step S104, the controller 31 determines work paths for excavating the slots S1 to S4 and the excavation walls W1 to W3. The work paths are target trajectories over which the work machine 1 moves in order to excavate the slots S1 to S4 and the excavation walls W1 to W3. The controller 31 determines the work paths so as to excavate the first slot S1, the second slot S2, the first excavation wall W1, the third slot S3, the second excavation wall W2, the fourth slot S4, and the third excavation wall W3 in order. The processing for determining the work paths is explained below.

In step S105, the controller 31 causes the work machine 1 to travel on the work paths. Consequently, the controller 31 excavates the first slot S1, the second slot S2, the first excavation wall W1, the third slot S3, the second excavation wall W2, the fourth slot S4, and the third excavation wall W3 in order.

Figure 6:
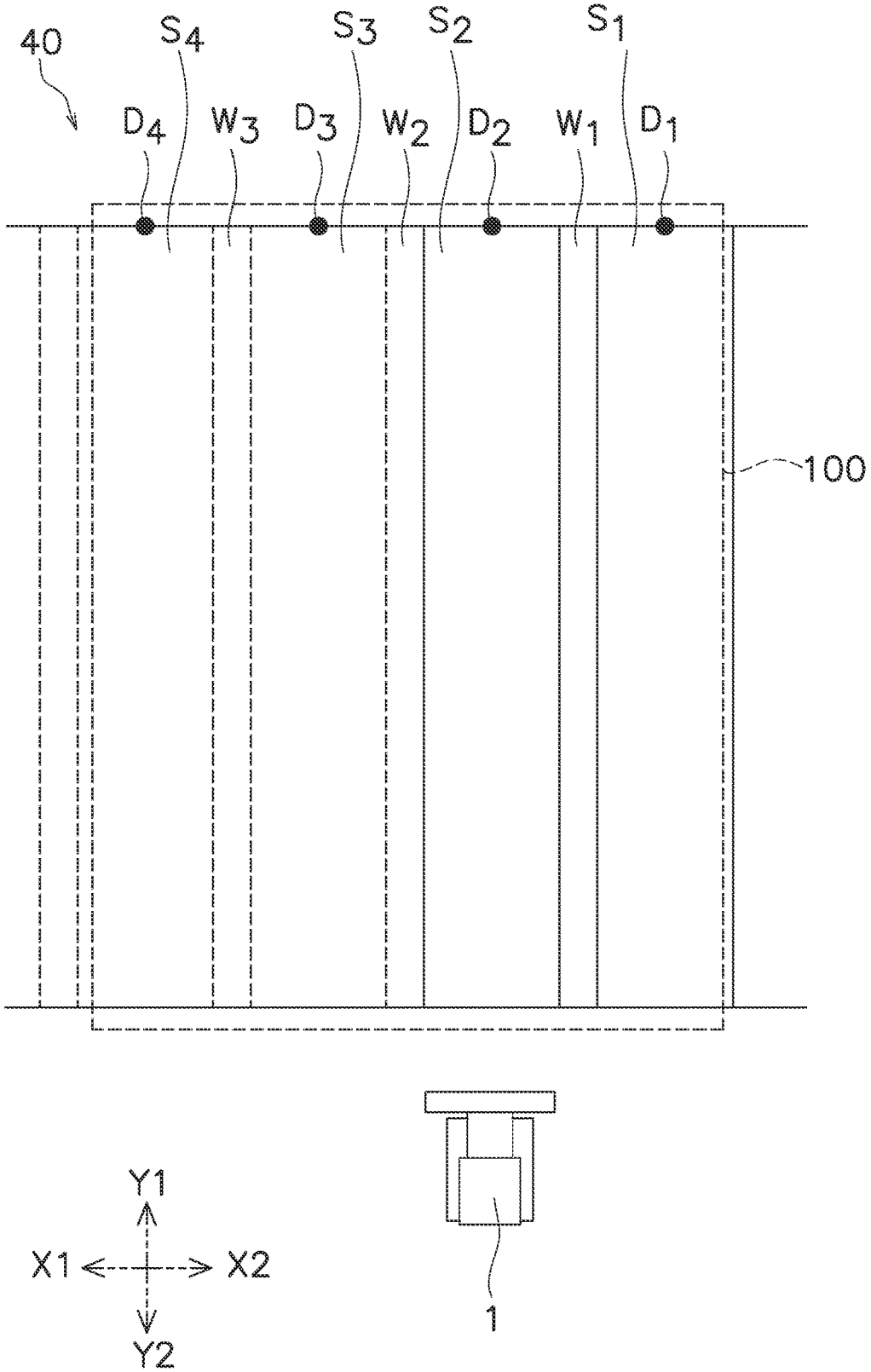
FIG. 6 is a top view of the actual topography illustrating work procedures based on a work path.
Figure 7:
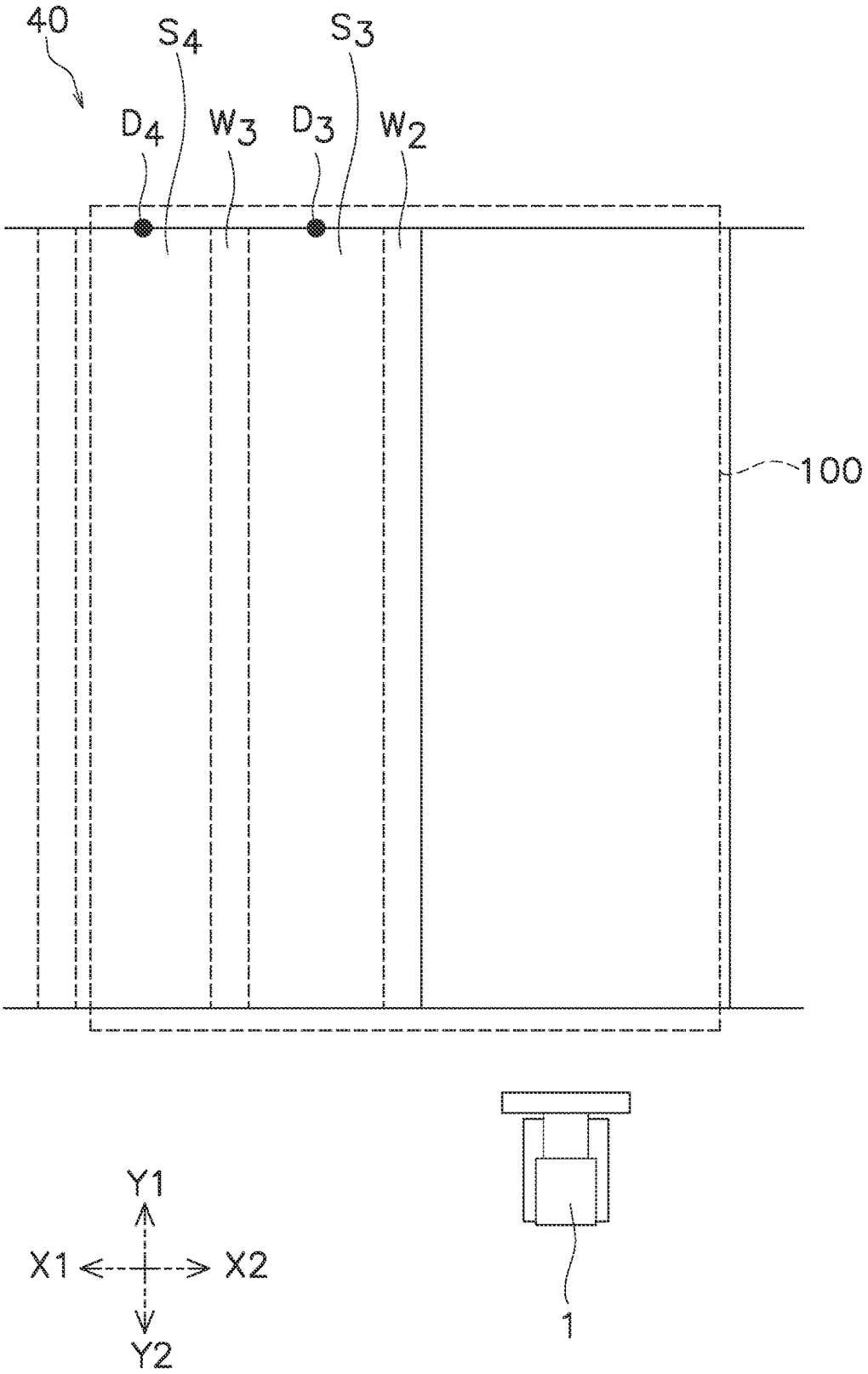
FIG. 7 is a top view of the actual topography illustrating the work procedures based on the work path.

As illustrated in FIG. 6, for example, the controller 31 first excavates the first slot S1 and then excavates the second slot S2. Consequently, the first excavation wall W1 is formed on the actual topography 40. Next, the controller 31 excavates the first excavation wall W1. Consequently, the first excavation wall W1 is removed from the actual topography 40 as illustrated in FIG. 7.

Figure 8:
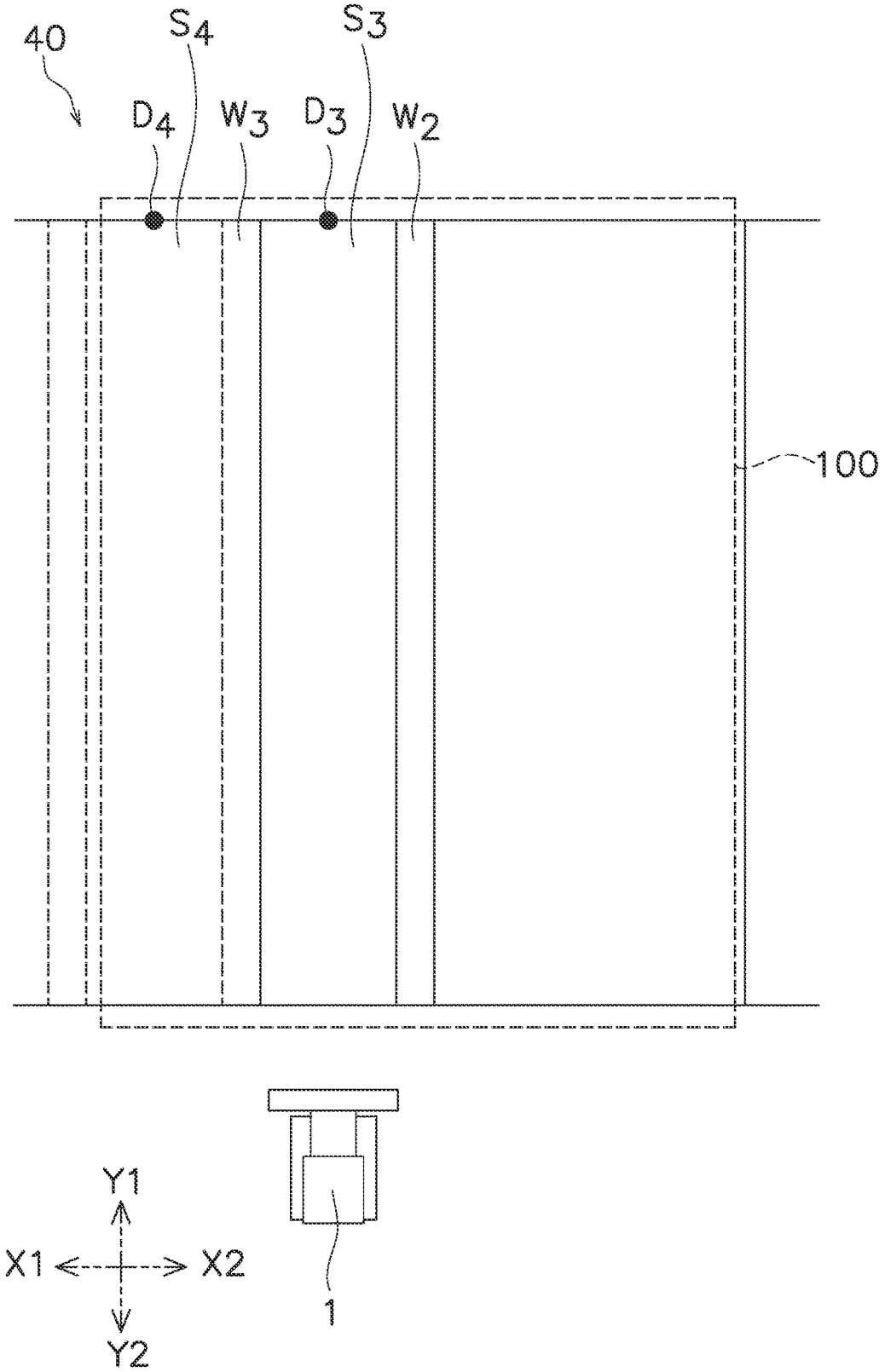
FIG. 8 is a top view of the actual topography illustrating the work procedures based on the work path.
Figure 9:
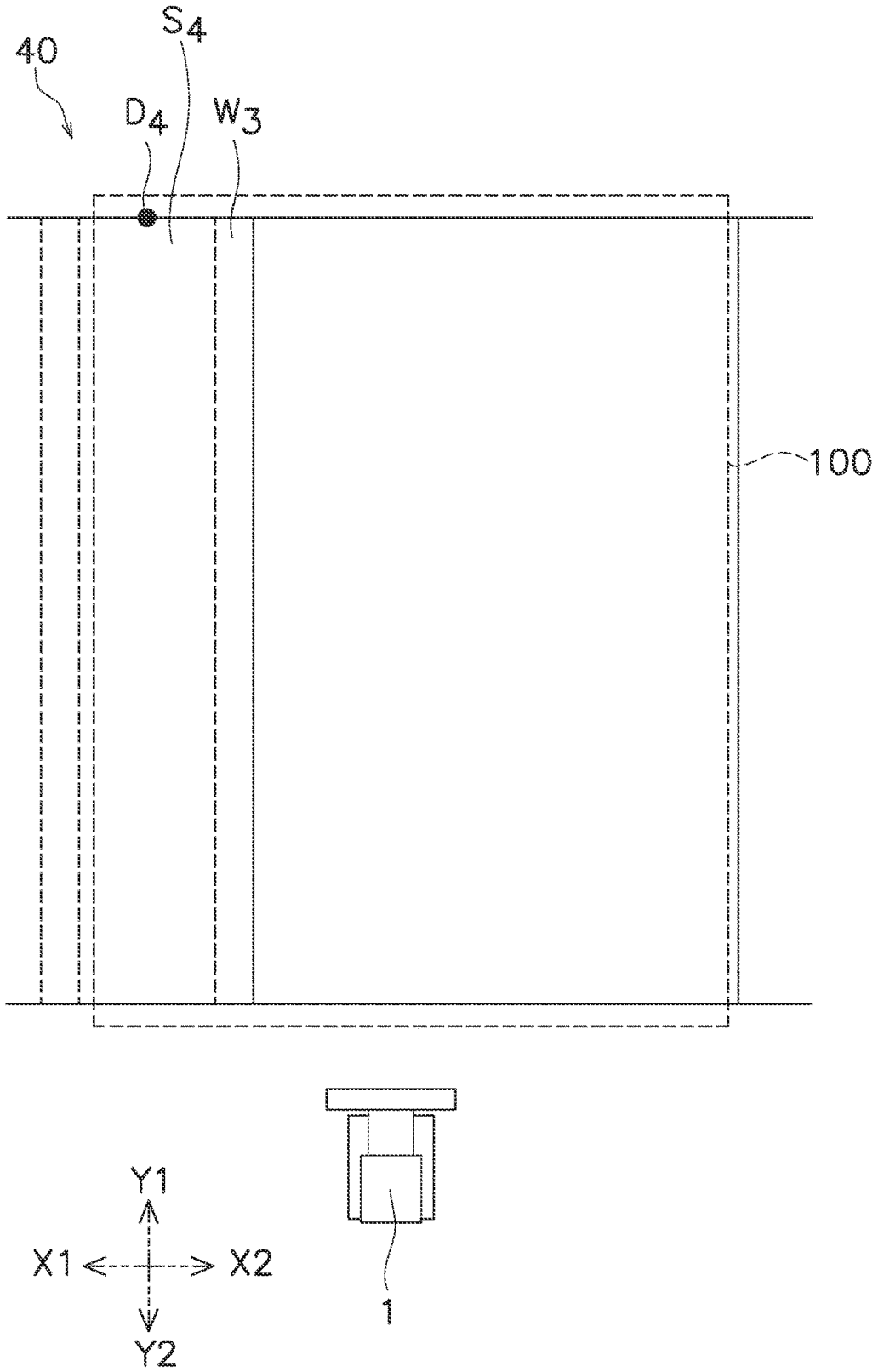
FIG. 9 is a top view of the actual topography illustrating the work procedures based on the work path.

Next, the controller 31 excavates the third slot S3. Consequently, the second excavation wall W2 is formed on the actual topography 40 as illustrated in FIG. 8. Next, the controller 31 excavates the second excavation wall W2. Consequently, the second excavation wall W2 is removed from the actual topography 40 as illustrated in FIG. 9. The controller 31 excavates the fourth slot S4 in the same way. Consequently, the third excavation wall W3 is formed on the actual topography 40. Next, the controller 31 excavates the third excavation wall W3. Consequently, the third excavation wall W3 is removed from the actual topography 40.

Figure 10:
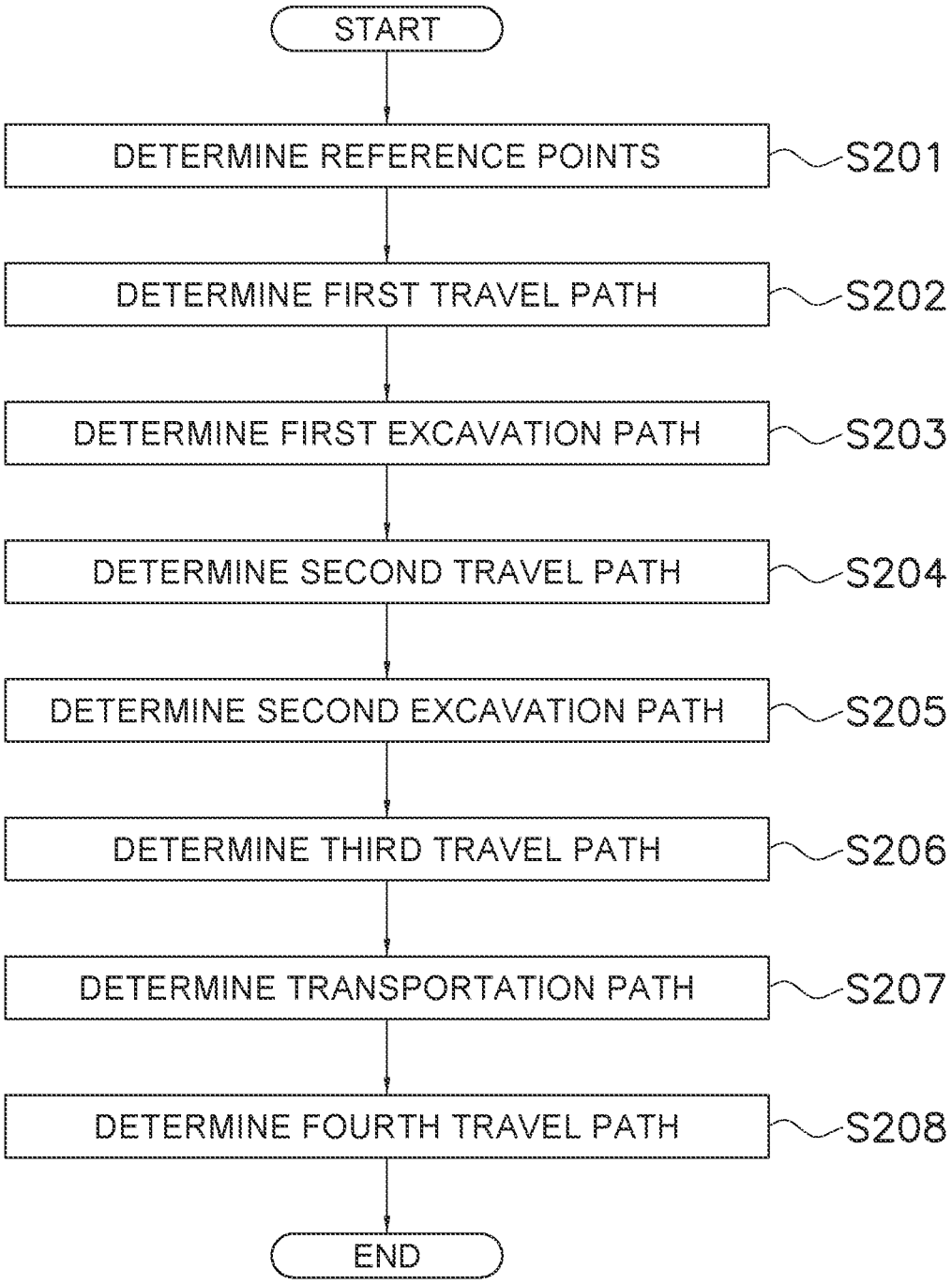
FIG. 10 is a flow chart illustrating a process for determining work paths for excavating excavation walls.

Processing for determining the work paths for excavating the excavation walls W1 to W3 will be explained in detail next. FIG. 10 is a flow chart illustrating processing for determining work paths for excavating the excavation walls W1 to W3. As illustrated in FIG. 10, in step S201, the controller 31 determines reference points on the excavation walls W1 to W3.

Figure 11:
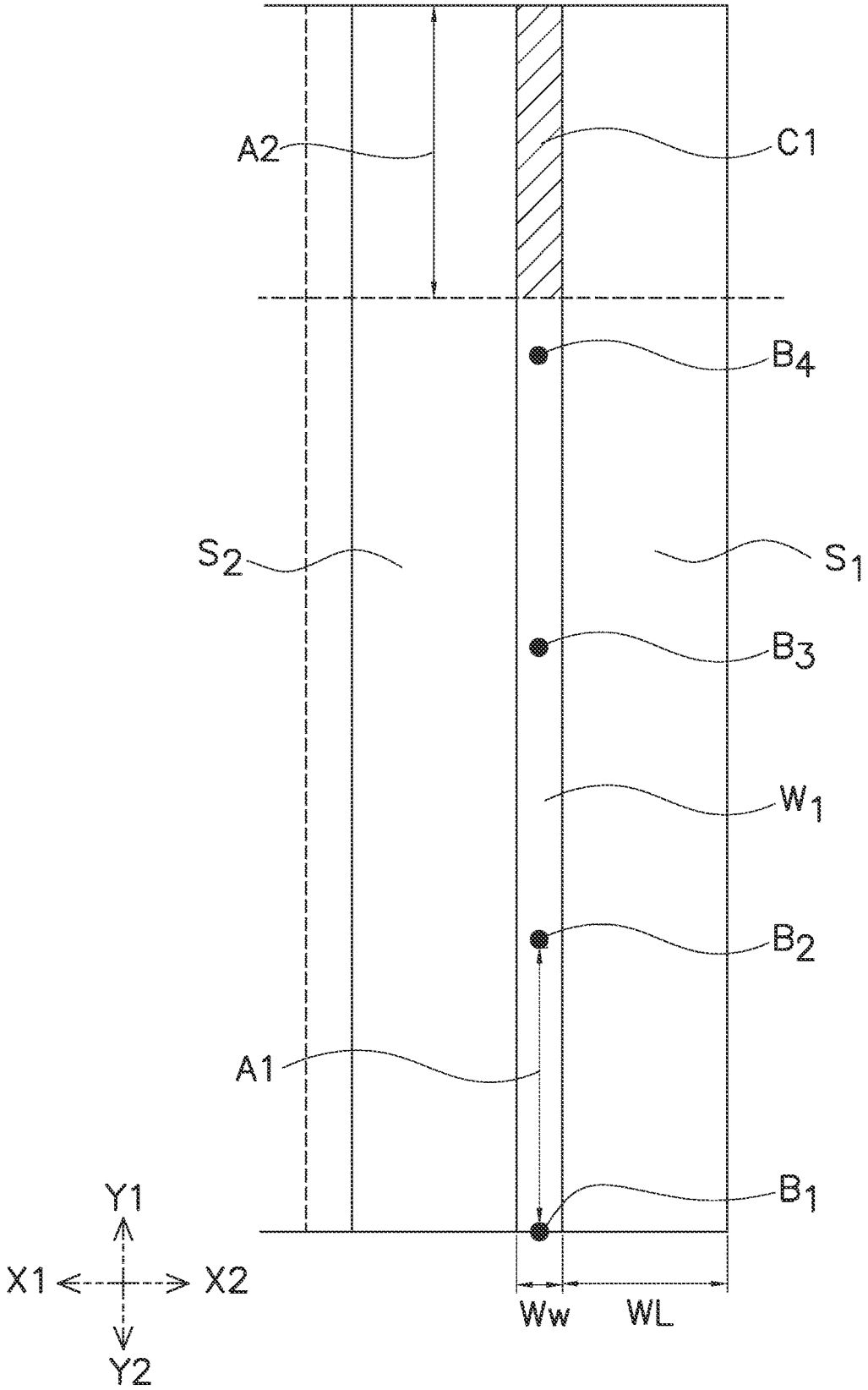
FIG. 11 illustrates processing for determining a reference point.

FIG. 11 illustrates an example of reference points B1 to B4 disposed on the first excavation wall W1. As illustrated in FIG. 11, the controller 31 arranges a first reference point B1 at the starting edge of the first excavation wall W1. The controller 31 disposes the reference points B2, B3, and B4 in increments of a predetermined first distance A1 on the first excavation wall W1 from the first reference point B1 in the first work direction Y1. However, the controller 31 does not dispose the reference points within a range C1 that is a predetermined second distance A2 rearward from the terminating edges in slots S1 and S2.

Figure 12:
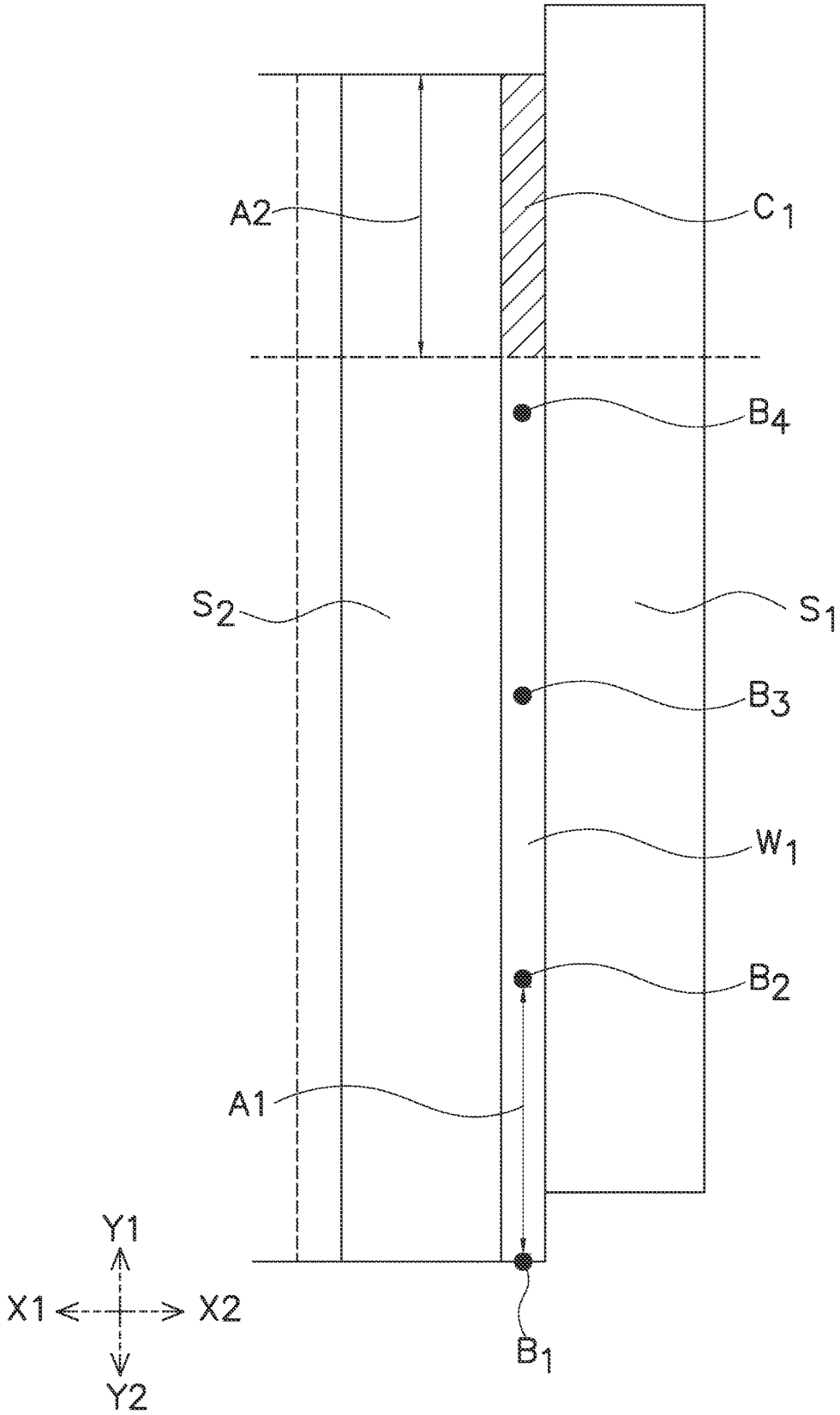
FIG. 12 illustrates processing for determining a reference point.

In the example illustrated in FIG. 12, when the positions of the terminating edges of the slots S1 and S2 are different, the controller 31 determines the range C1 based on the terminating edge of the slot S2 that is the position of the terminating edge among the two slots S1 and S2 adjacent to the first excavation wall W1 closest to the starting edge of the first excavation wall W1. The disposition of the reference points B1 to B4 may be determined based on the actual topography 40 after the slots adjacent to the excavation walls have been excavated. Alternatively, the disposition of the reference points B1 to B4 may be previously determined before the start of excavation of the slots.

The first distance A1 is determined with the following equation (1).

$$A1 = 2*(WL/2)/\sin\theta \tag{1}$$

The second distance A2 is determined with the following equation (2).

$$A2 = (WL/2 + Ww + a1)/\tan\theta + (WL/2)/\sin\theta + a2 \tag{2}$$

As illustrated in FIG. 11, WL is the width of the slots S1 and S2. Ww is the width of the excavation walls W1 to W3. θ is the inclination angle with respect to the first work direction Y1 of a below-mentioned excavation path. a1 and a2 are predetermined constants. a1, a2, and θ may be changed. a1, a2, and θ may be changed, for example, by the operator with the input device 35.

In step S202, the controller 31 determines a first travel path. The first travel path is a target path on which the work machine 1 moves up to a first starting position F1 of a below-mentioned first excavation path PA7 after the completion of the excavation of the second slot S2. The first travel path includes paths PA1 to PA6 illustrated in FIG. 13-16. The controller 31 causes the work machine 1 to move so that a first coordinate point O1 included on the vehicle body 11 follows the paths PA1 to PA6 as illustrated in FIG. 13-16. The first coordinate point O1 is, for example, the center of gravity position in the design of the work machine 1. Alternatively, the first coordinate point O1 may be the center position of the vehicle body 11. Alternatively, the first coordinate point O1 may be the center position that includes the vehicle body 11 and the travel device 12.

Figure 13:
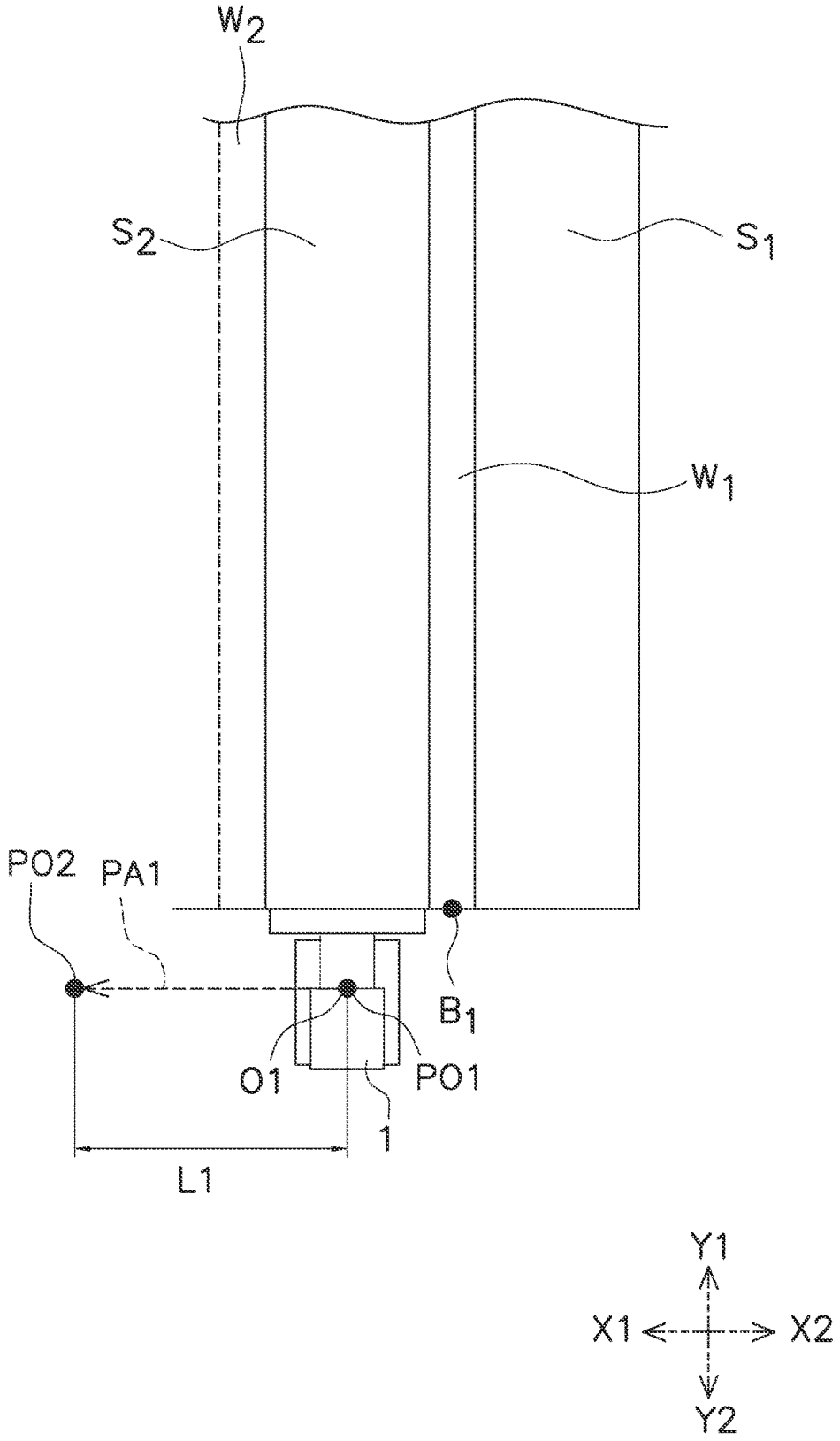
FIG. 13 illustrates a first travel path.

FIG. 13 illustrates a position PO1 of the work machine 1 after the completion of the excavation of the second slot S2. The work machine 1 is oriented in the first work direction Y1 and the blade tip of the blade 18 is placed at the starting edge of the second slot S2 at the position P01. The controller 31 determines the path PA1 that extends from the position PO1 to a position P02. The position PO2 is a position spaced away from the position PO1 by a distance L1 in the first transverse direction X1. The first transverse direction X1 is perpendicular to the first work direction Y1 and is oriented from the first slot S1 to the second slot S2.

Figure 14:
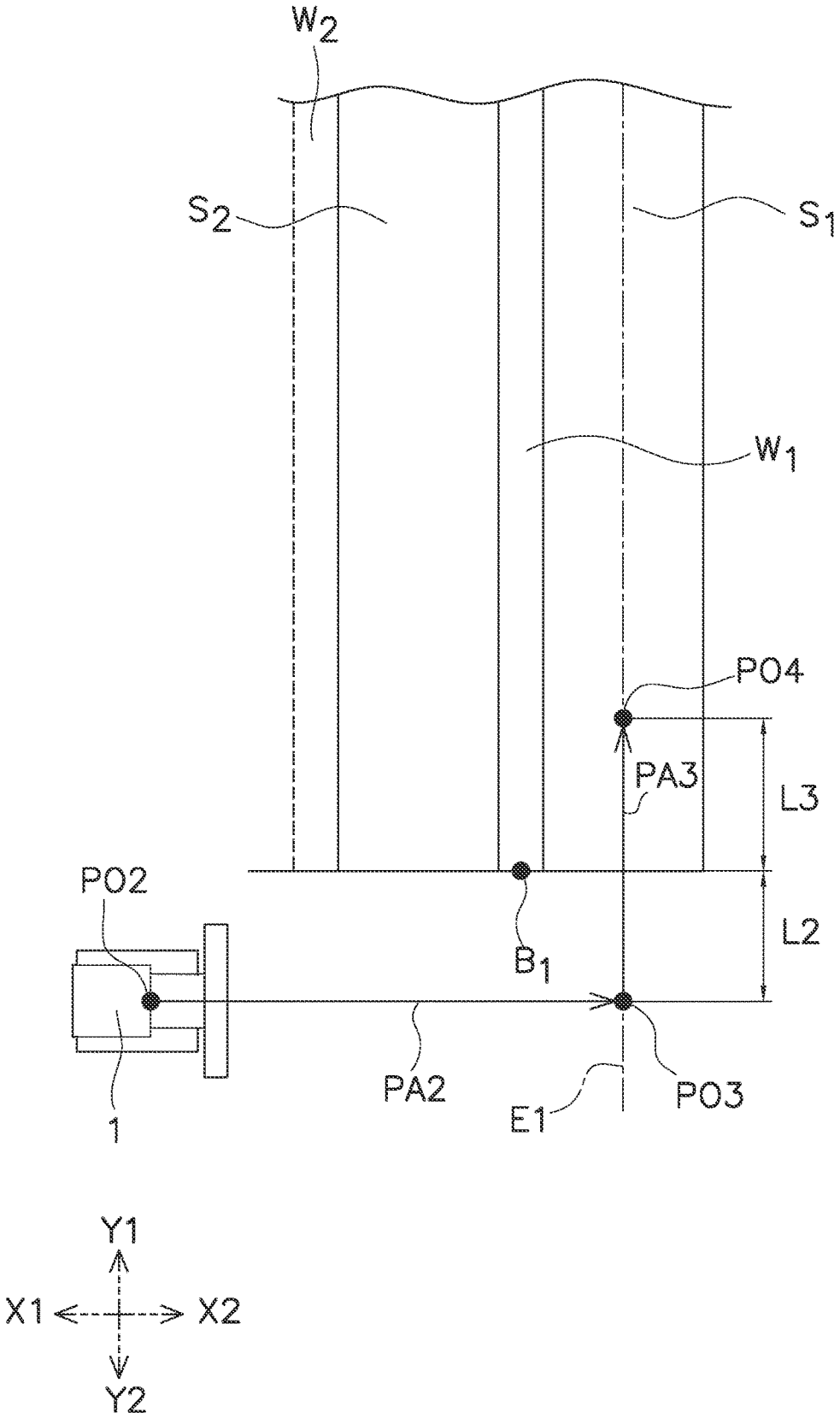
FIG. 14 illustrates the first travel path.

The controller 31 causes the work machine 1 to travel in reverse along the path PA1. Consequently, as illustrated in FIG. 14, the work machine 1 is oriented in the second transverse direction X2 and moves from the position PO1 to the position PO2. The second transverse direction X2 is the direction opposite the first transverse direction X1. The second transverse direction X2 is perpendicular to the first work direction Y1 and is oriented from the second slot S2 to the first slot S1. The solid line arrows in the drawings indicate forward travel paths. The dashed line arrows indicate reverse travel paths.

As illustrated in FIG. 14, the controller 31 determines the path PA2 that extends from the position PO2 to a position PO3 and determines the path PA3 that extends from the position P03 to a position PO4. The position PO3 is a position spaced away from the first reference point B1 by a distance L2 in a first reverse direction Y2 on a straight line E1 that passes through the center in the transverse directions X1, X2 of the first slot S1. The first reverse direction Y2 is opposite to the first work direction Y1. The position PO4 is a position spaced away from the first reference point B1 by a distance L3 in the first work direction Y1 on the straight line E1. The controller 31 causes the work machine 1 to travel forward along the paths PA2 and PA3. Consequently, as illustrated in FIG. 15, the work machine 1 moves from the position PO2 to the position PO4 through the position PO3.

Figure 15:
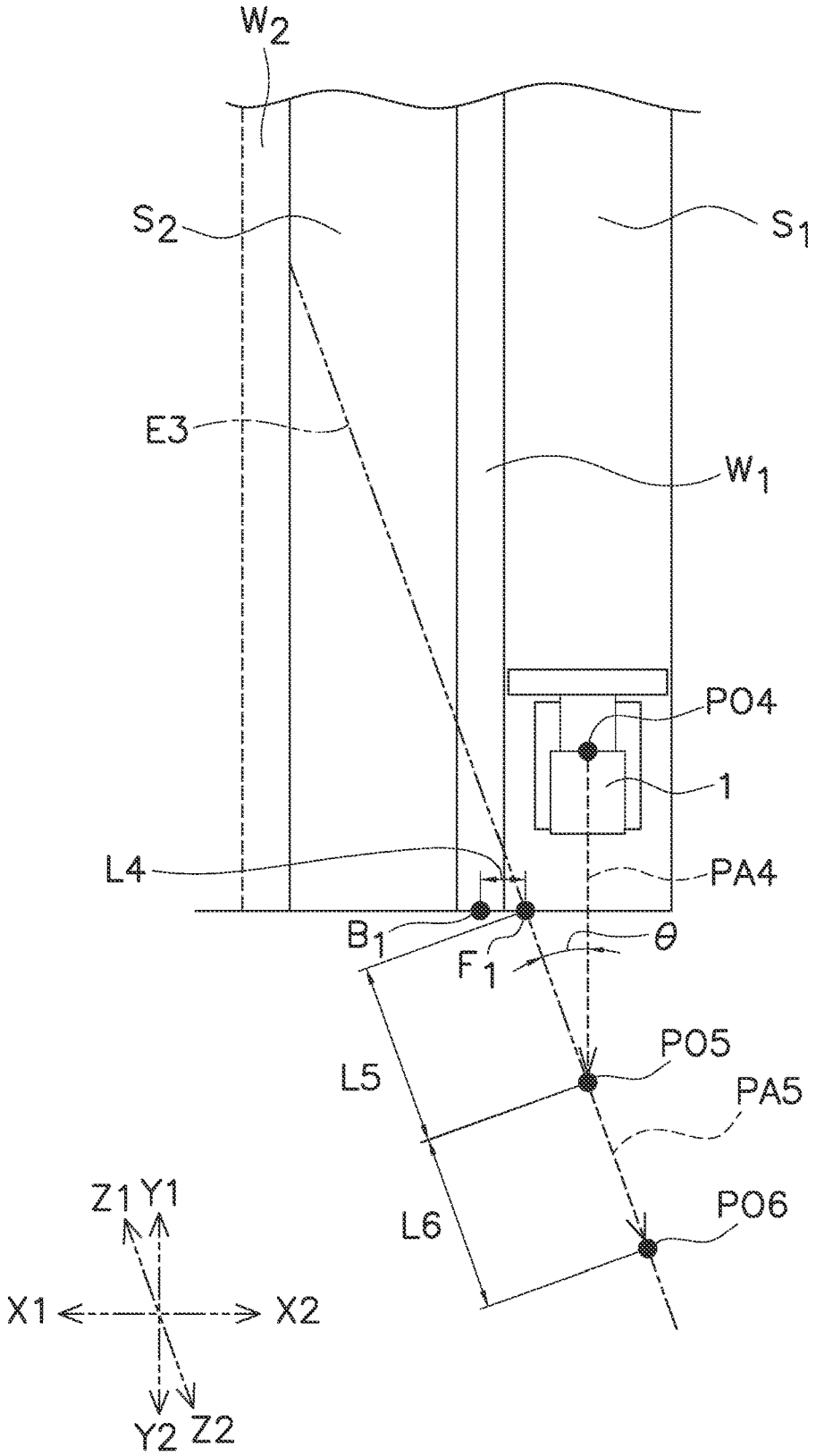
FIG. 15 illustrates the first travel path.

As illustrated in FIG. 15, the controller 31 determines the path PA4 that extends from the position PO4 to a position PO5, and the path PA5 that extends from the position PO5 to a position PO6. The position PO5 is a position spaced away by a distance L5 from the first starting position F1 in a second reverse direction Z2. The first starting position F1 is a position spaced away from the first reference point B1 by a distance L4 in the second transverse direction X2 and is on the first slot S1. The second reverse direction Z2 is a direction opposite a second work direction Z1. The second work direction Z2 is the direction in which the first work direction Y1 is rotated by angle θ. The position PO6 is a position spaced away by a distance L6 from the position PO5 in the second reverse direction Z2. The controller 31 causes the work machine 1 to travel in reverse along the paths PA4 and PA5. Consequently, as illustrated in FIG. 16, the work machine 1 moves from the position PO4 through the position PO5 to the position PO6 oriented in the second work direction Z1.

Figure 16:
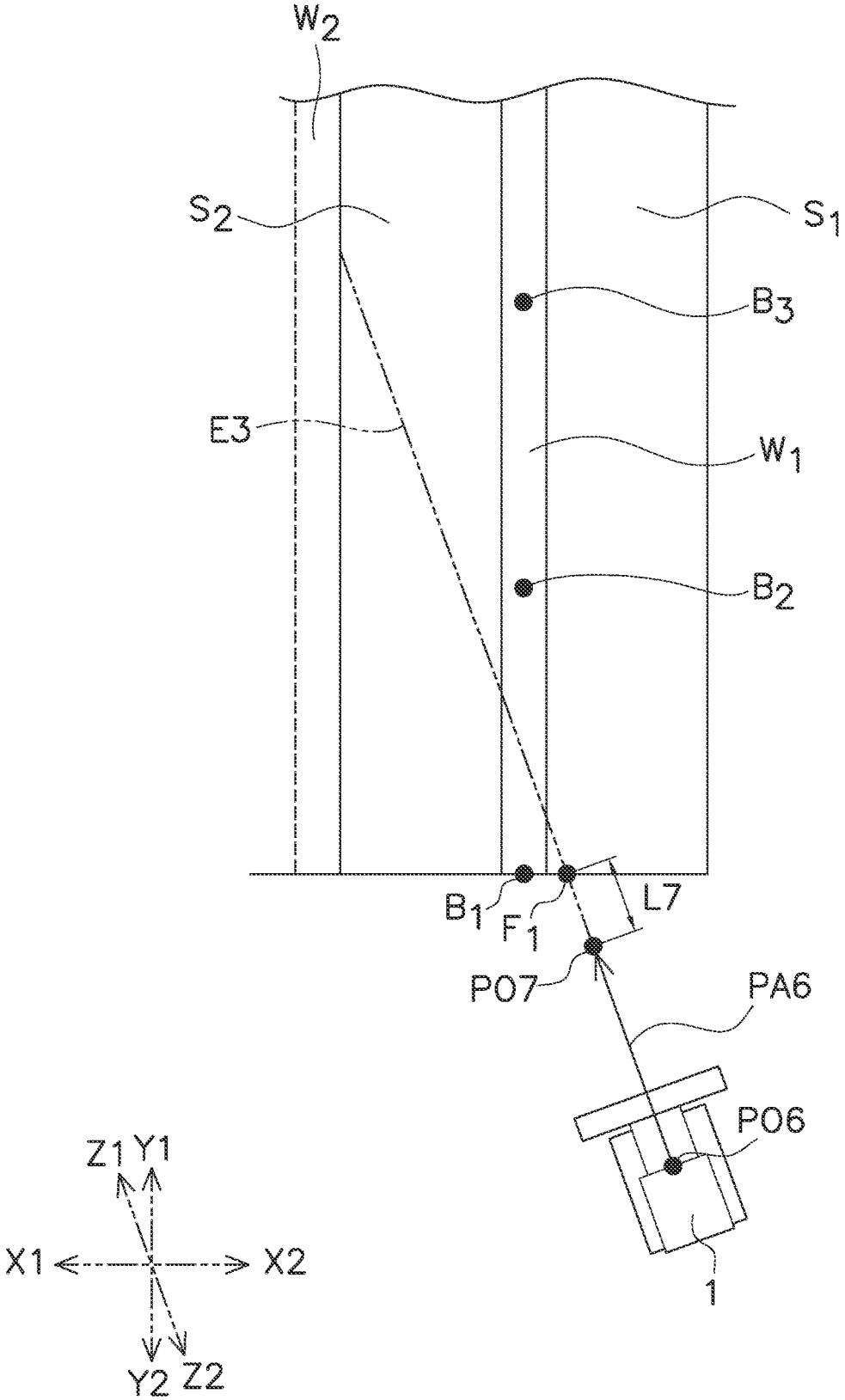
FIG. 16 illustrates the first travel path.
Figure 17:
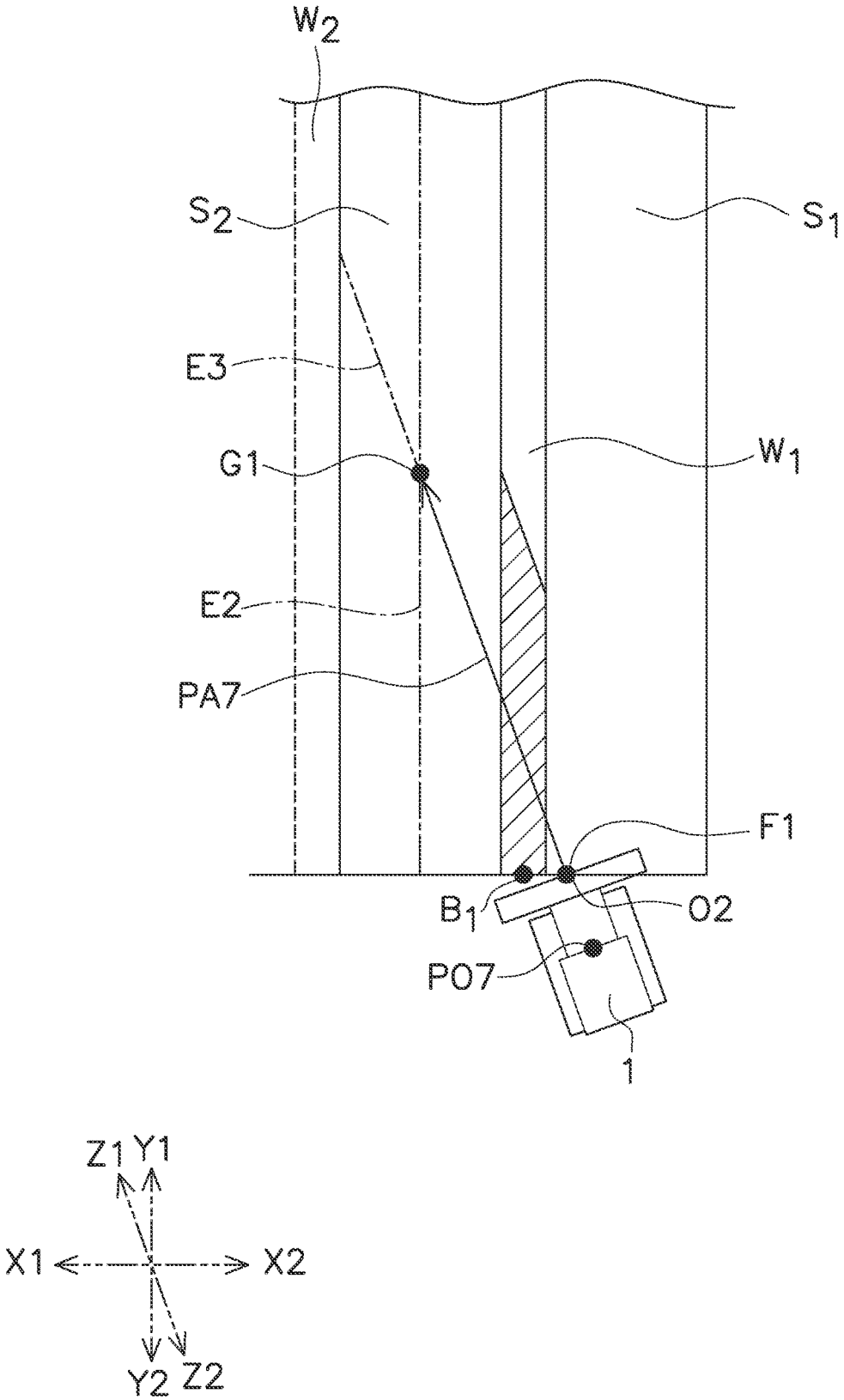
FIG. 17 illustrates a first excavation path.

As illustrated in FIG. 16, the controller 31 determines the path PA6 that extends from the position PO6 to a position PO7. The position PO7 is a position spaced away by a distance L7 from the first starting position F1 in the second reverse direction Z2. The position PO7 is the position of the first coordinate point O1 when a below-mentioned second coordinate point O2 included in the blade 18 is positioned at the first starting position F1. The controller 31 causes the work machine 1 to travel forward along the path PA6. Consequently, as illustrated in FIG. 17, the work machine 1 moves from the position PO6 to the position PO7.

Figure 18:
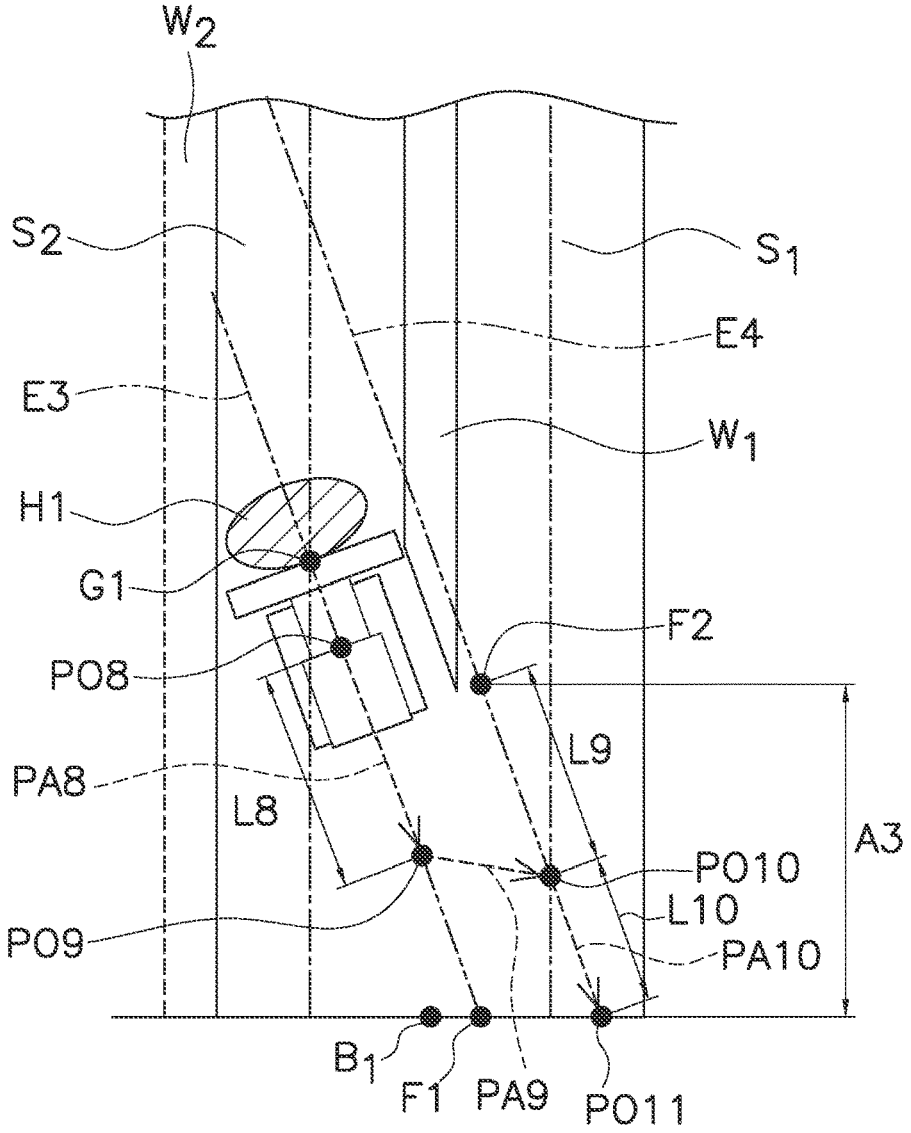
FIG. 18 illustrates a second travel path.
Figure 18:
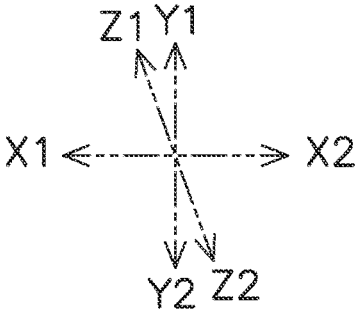

In step S203, the controller 31 determines a first excavation path PA7. The first excavation path PA7 is a target path for excavating the first excavation wall W1. The first excavation path PA7 extends from the first starting position F1 to a first target position G1 on the second slot S2 and cuts across the first excavation wall W1. The first excavation path PA7 is inclined by the angle θ with respect to the first work direction Y1. The first target position G1 is the intersection of a straight line E3 that extends from the first starting position F1 in the second work direction Z1, and a straight line E2 that passes through the center of the second slot S2 in the transverse directions X1, X2. The controller 31 causes the work machine 1 to travel forward along the first excavation path PA7. As illustrated in FIG. 17, the controller 31 causes the work machine 1 to move so that the second coordinate point O2 included in the blade tip of the blade 18 follows the first excavation path PA7. Consequently, as illustrated in FIG. 18, the first excavation wall W1 is excavated and a first pile of soil H1 excavated from the first excavation wall W1 is placed on the second slot S2. For example, the second coordinate point O2 is the center position in the width direction at the bottom end of the blade tip of the blade 18.

Figure 19:
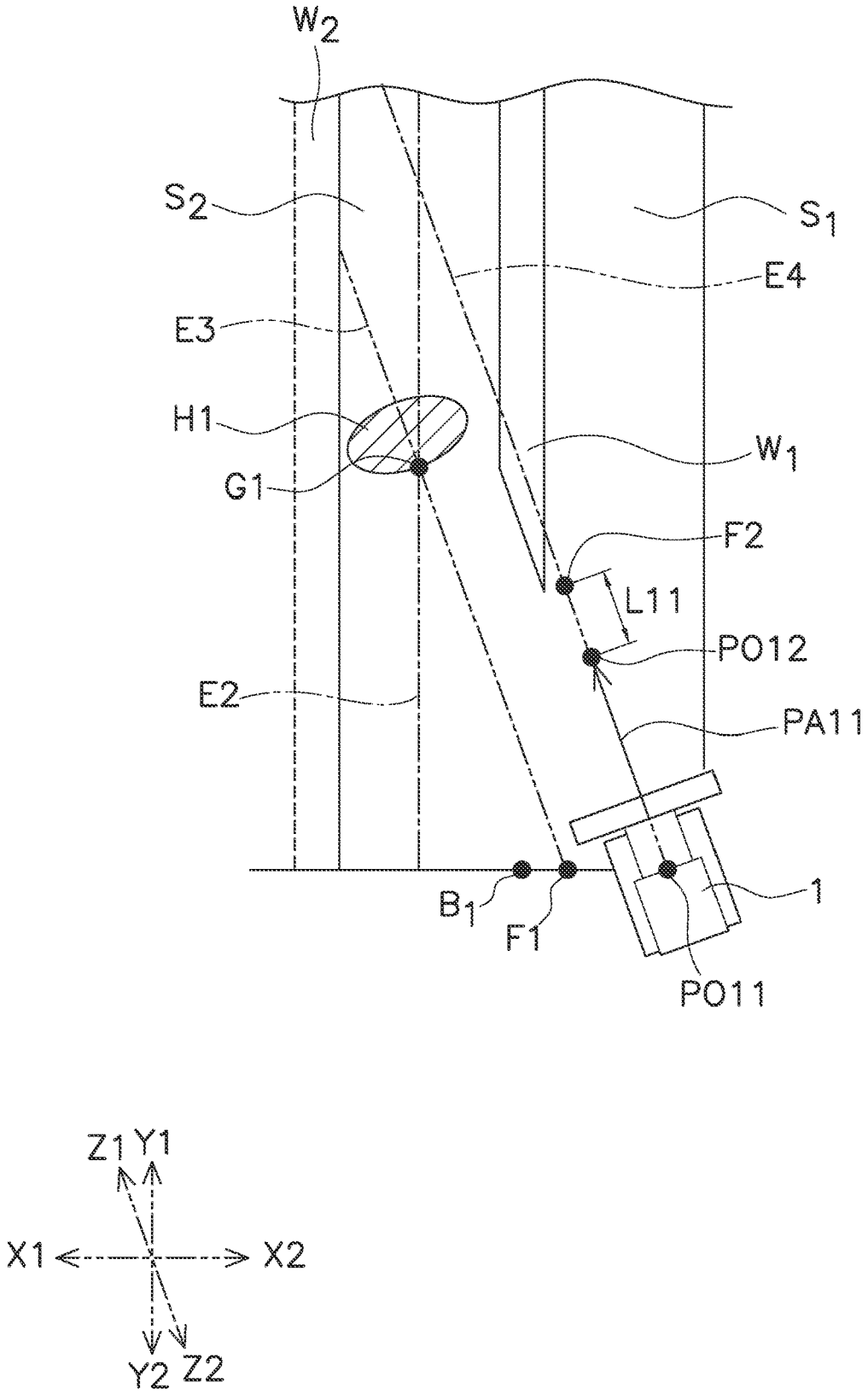
FIG. 19 illustrates the second travel path.

In step S204, the controller 31 determines a second travel path. The second travel path is a target path for moving from the first target position G1 to a second starting position F2 of a below-mentioned second excavation path PA12. As illustrated in FIGS. 18 and 19, the second travel path includes paths PA8 to PA11. The controller 31 causes the work machine 1 to move so that the above-mentioned first coordinate point O1 follows the paths PA8 to PA11.

As illustrated in FIG. 18, the controller 31 determines the path PA8 that extends from a position PO8 to a position PO9, the path PA9 that extends from the position PO9 to a position PO10, and the path PA10 that extends from the position PO10 to a position PO11. The position PO8 is the position of the first coordinate point O1 while the above-mentioned second coordinate point O2 is positioned at the first target position G1. The position PO9 is a position spaced away from the position PO8 by a distance L8 in the second reverse direction Z2. The position PO10 is a position spaced away from the second starting position F2 by a distance L9 in the second reverse direction Z2. The position PO11 is a position spaced away from the position PO10 by a distance L10 in the second reverse direction Z2. The distances L9 and L10 may be the same as the above-mentioned distances L5 and L6 respectively.

The second starting position F2 is a position spaced away from the first starting position F1 by the distance A3 in the first work direction Y1. The third distance A3 is determined with the following equation (3).

$$A3 = (WL/2)/\sin\theta \tag{3}$$

The controller 31 causes the work machine 1 to travel in reverse along the paths PA8 to PA10. Consequently, as illustrated in FIG. 19, the work machine 1 moves from the position PO8 to the position PO11 through the positions PO9 and PO10.

Figure 20:
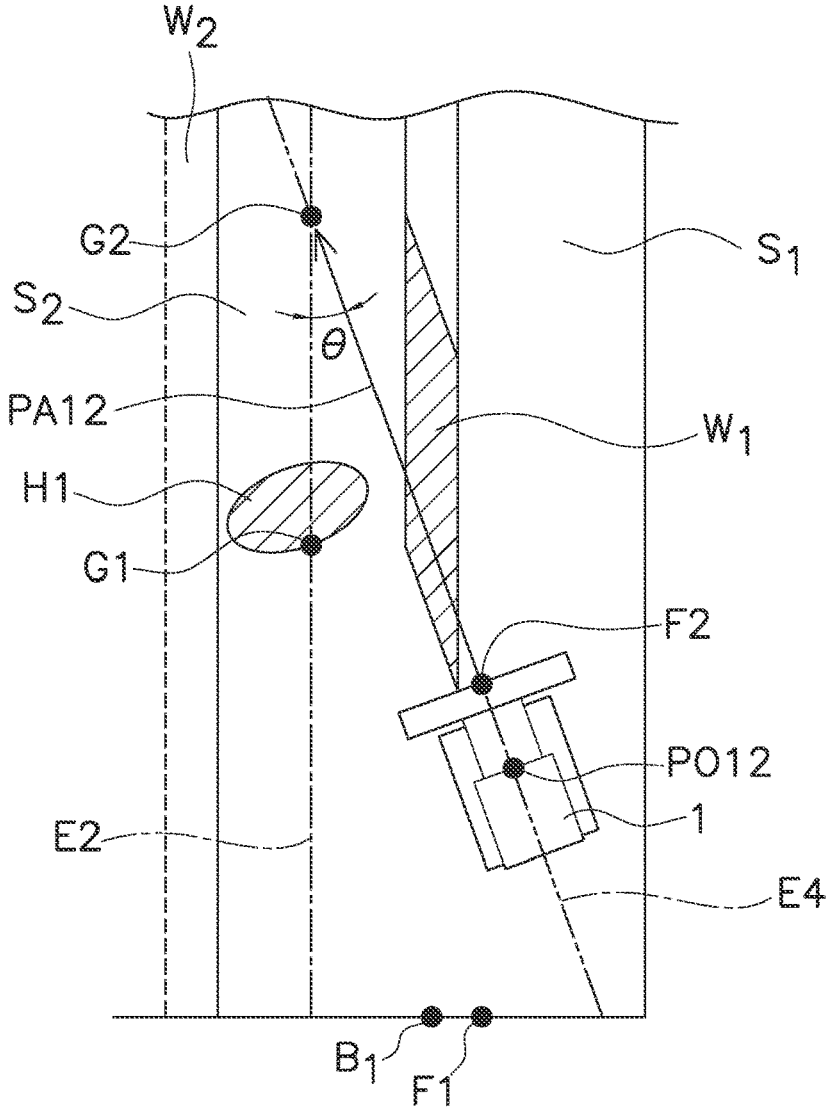
FIG. 20 illustrates a second excavation path.
Figure 20:
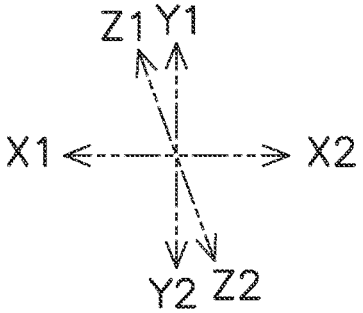

As illustrated in FIG. 19, the controller 31 determines the path PA11 that extends from the position PO11 to a position PO12. The position PO12 is a position spaced away from the second starting position F2 by a distance L11 in the second reverse direction Z2. The distance L11 may be the same as the above-mentioned distance L7. The position PO12 is the position of the first coordinate point O1 when the second coordinate point O2 is positioned at the second starting position F2 in the second work direction Z1. The controller 31 causes the work machine 1 to travel forward along the path PA11. Consequently, as illustrated in FIG. 20, the work machine 1 moves from the position PO11 to the position PO12.

In step S205, the controller 31 determines a second excavation path PA12. The second excavation path PA12 is a target path for excavating the first excavation wall W1. The second excavation path PA12 is positioned forward of the first excavation path PA7 in the first work direction Y1. The second excavation path PA12 extends from the second starting position F2 to a second target position G2 on the second slot S2 and cuts across the first excavation wall W1. The second excavation path PA12 is inclined by the angle θ with respect to the first work direction Y1.

The second target position G2 is the intersection of a straight line E4 that extends from the second starting position F2 in the second work direction Z1, and the straight line E2 that passes through the center of the second slot S2 in the transverse directions X1, X2. The second target position G2 is positioned forward of the first target position G1 in the first work direction Y1. The controller 31 causes the work machine 1 to travel forward along the second excavation path PA12. The controller 31 causes the work machine 1 to move so that the above-mentioned second coordinate point O2 follows the second excavation path PA12. Consequently, as illustrated in FIG. 21, the first excavation wall W1 is excavated and a second pile of soil H2 excavated from the first excavation wall W1 is placed on the second slot S2.

Figure 22:
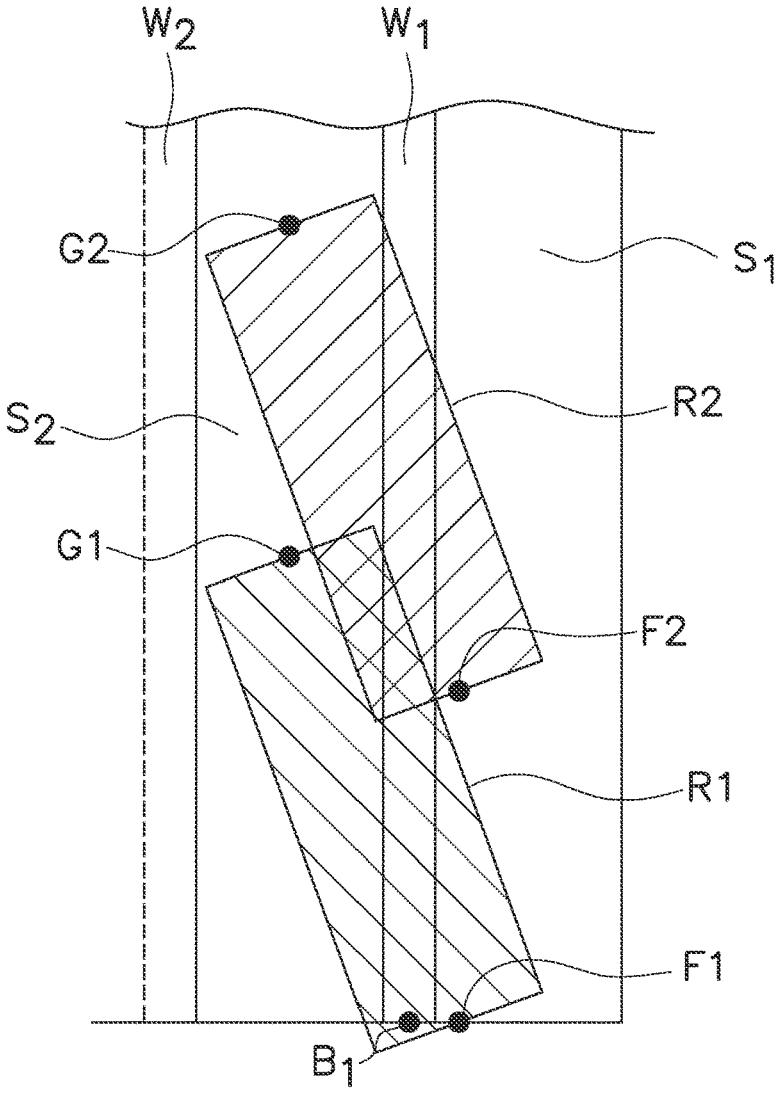
FIG. 22 illustrates a first movement range and a second movement range of the blade during excavation.
Figure 22:
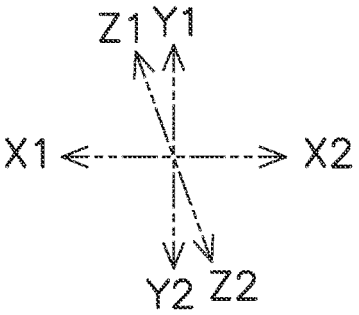

FIG. 22 illustrates a first movement range R1 of the blade 18 in accordance with the first excavation path PA7, and a second movement range R2 of the blade 18 in accordance with the second excavation path PA12. As illustrated in FIG. 22, the second movement range R2 partially overlaps the first movement range R1.

In step S206, the controller 31 determines a third travel path. The third travel path is a target path for moving from the second target position G2 to a below-mentioned third starting position F3 of a transportation path PA16. As illustrated in FIG. 21, the third travel path includes paths PA13 to PA15. The controller 31 causes the work machine 1 to move so that the above-mentioned first coordinate point O1 follows the paths PA13 to PA15.

Figure 21:
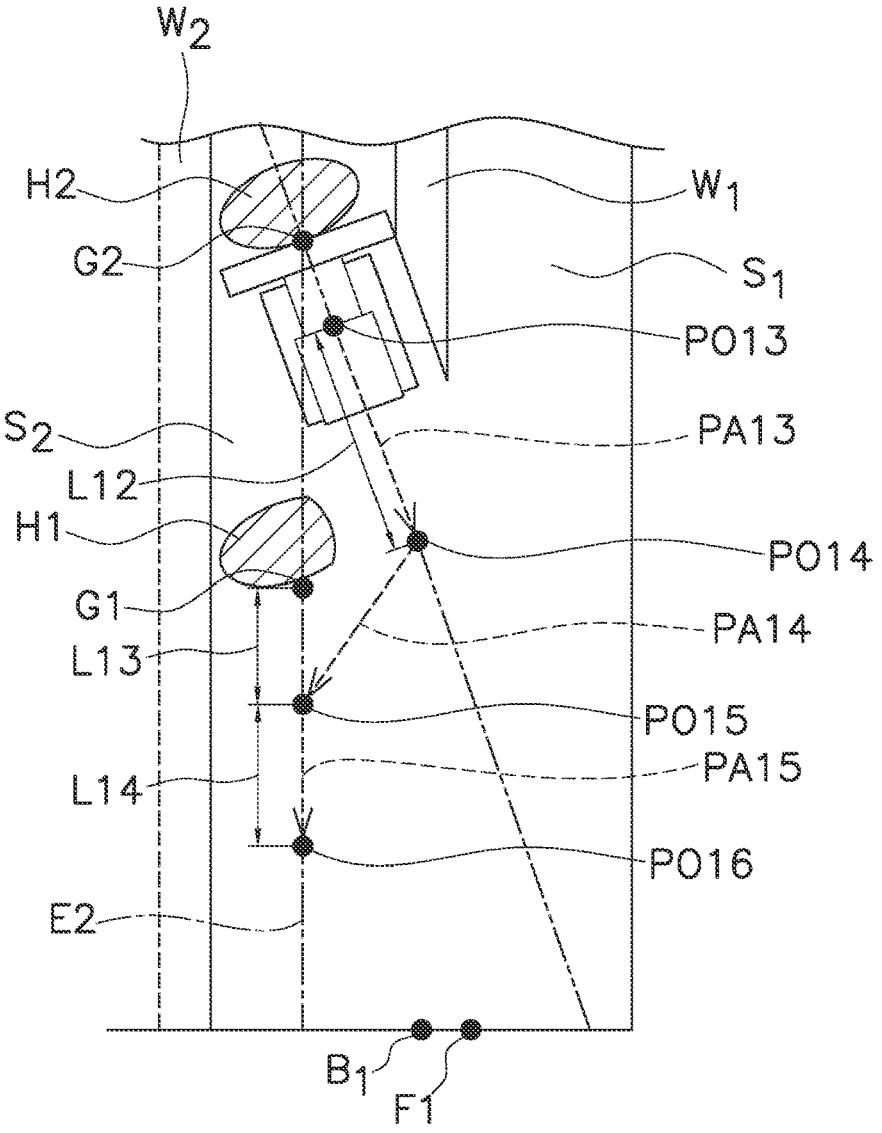
FIG. 21 illustrates a third travel path.
Figure 21:
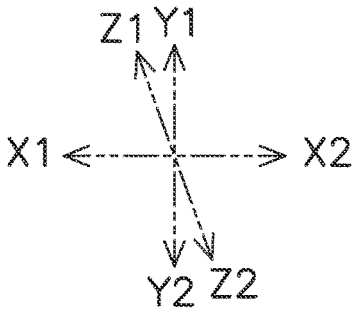

As illustrated in FIG. 21, the controller 31 determines the path PA13 that extends from a position PO13 to a position PO14, the path PA14 that extends from the position PO14 to a position P015, and the path PA15 that extends from the position PO15 to a position PO16. The position P013 is a position of the first coordinate point O1 while the second coordinate point O2 is positioned at the second target position G2. The position PO14 is a position spaced away from the position P013 by a distance L12 in the second reverse direction Z2. The position PO15 is a position spaced away by a distance L13 from the first target position G1 in the first reverse direction Y2. The position P016 is a position spaced away from the position PO15 by a distance L14 in the first reverse direction Y2. The distance L12 may be the same as the above-mentioned distance L8.

The controller 31 causes the work machine 1 to travel in reverse along the paths PA13 to PA15. Consequently, as illustrated in FIG. 21, the work machine 1 moves from the position PO13 through the positions PO14 and PO15, to the position PO16 oriented in the first work direction Y1.

Figure 23:
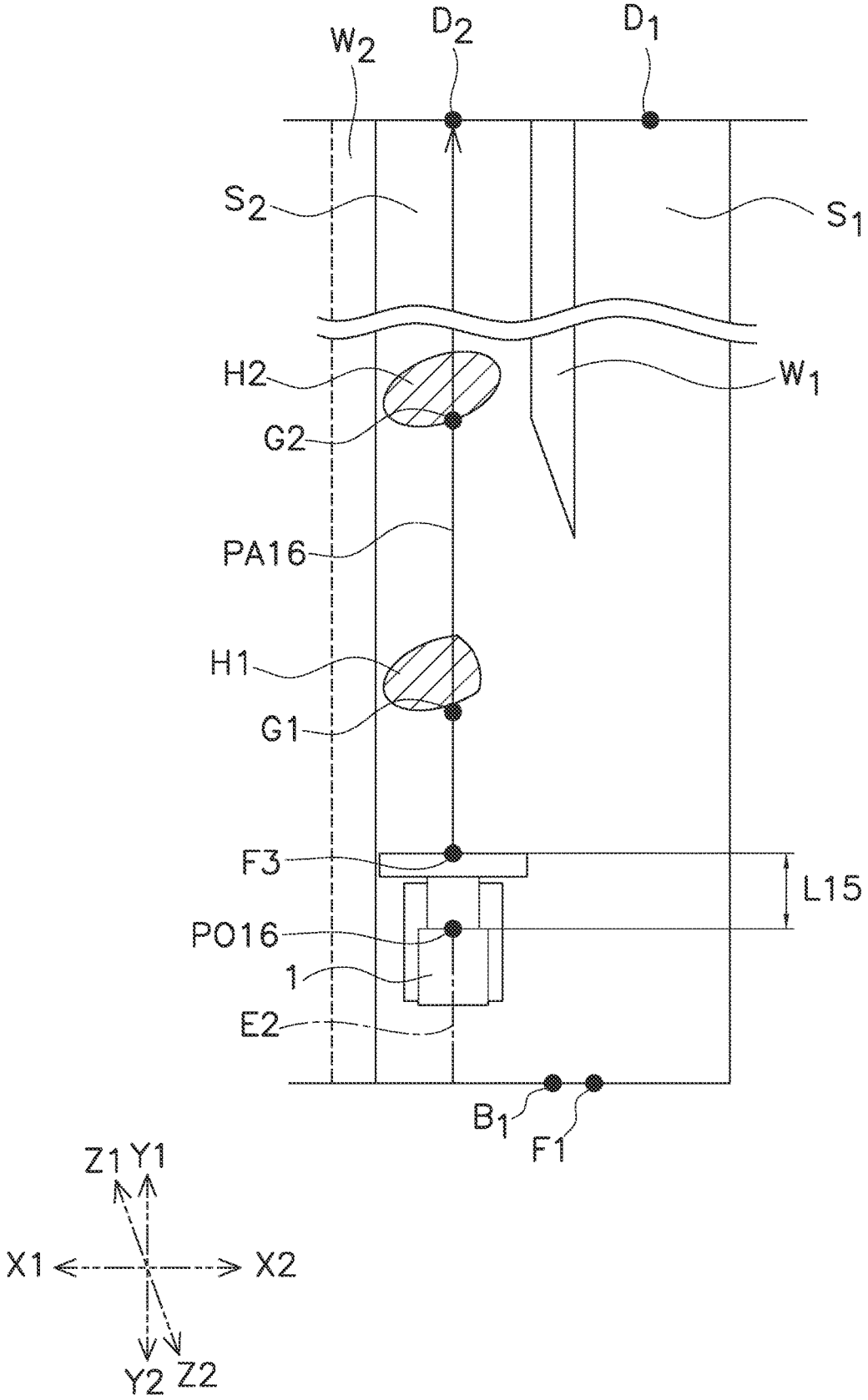
FIG. 23 illustrates a transportation path.

In step S207, the controller 31 determines the transportation path PA16. As illustrated in FIG. 23, the transportation path PA16 extends from a third starting position F3 along the second slot S2 to a soil unloading position D2. The third starting position F3 is positioned rearward of the first target position G1 in the first work direction Y1. The controller 31 determines the transportation path PA16 so as to pass through the first target position G1 and the second target position G2.

The controller 31 determines the transportation path PA16 that extends from the third starting position F3 to the soil unloading position D2. The third starting position F3 is a position spaced away from the position PO16 by a distance L15 in the first work direction Y1. The distance L15 may be the same as the above-mentioned distance L7 or L11. The position PO16 is the position of the first coordinate point O1 when the second coordinate point O2 is positioned at the third starting position F3 in the first work direction Y1. The controller 31 causes the work machine 1 to move so that the above-mentioned second coordinate point O2 follows the transportation path PA16. Consequently, the first pile of soil H1 and the second pile of soil H2 on the second slot S2 are transported to the soil unloading position D2.

Figure 24:
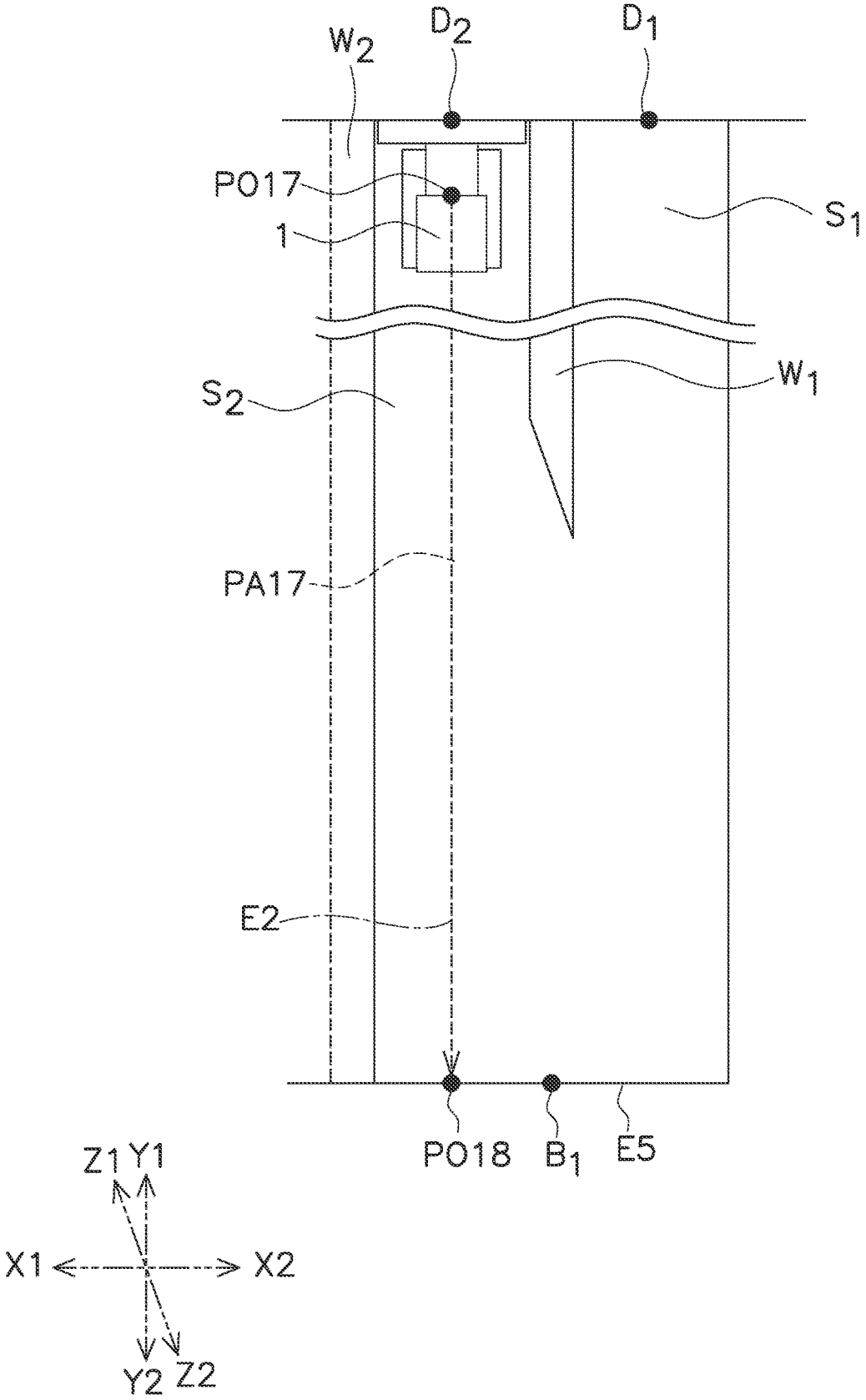
FIG. 24 illustrates a fourth travel path.
Figure 25:
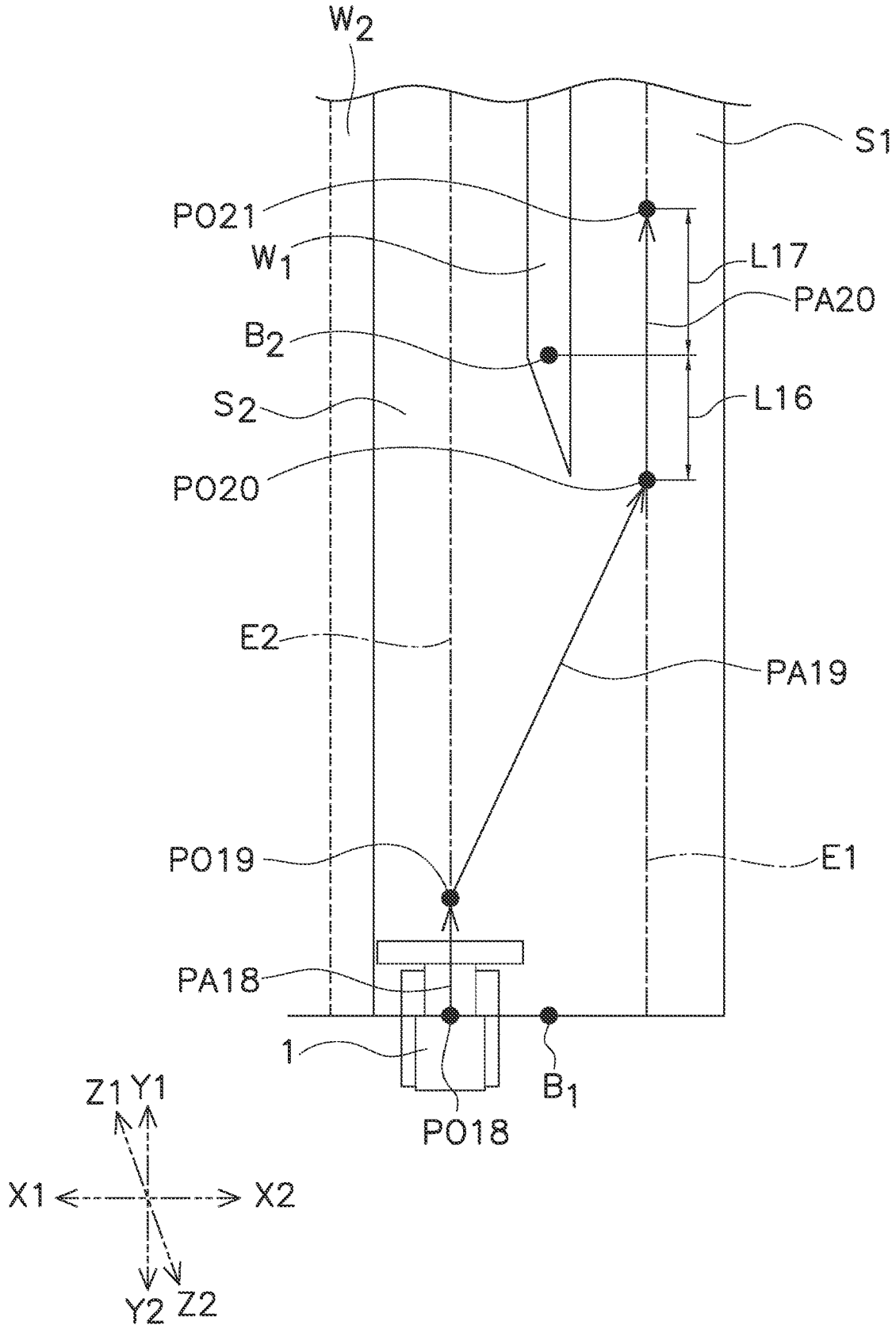
FIG. 25 illustrates the fourth travel path.

In step S208, the controller 31 determines a fourth travel path. The fourth travel path is a target path for moving the work machine 1 from the soil unloading position D2 to the first starting position of the first excavation path based on the second reference point B2. The fourth travel path includes paths PA17 to PA20 as illustrated in FIGS. 24 and 25. The controller 31 causes the work machine 1 to move so that the above-mentioned first coordinate point O1 follows the paths PA17 to PA20.

As illustrated in FIG. 24, the controller 31 determines the path PA17 that extends from a position PO17 to a position PO18. The position PO17 is a position of the first coordinate point O1 while the above-mentioned second coordinate point O2 is positioned at the soil unloading position D2. The PO18 is the intersection of a straight line E5 that passes through the first reference point B1 and extends in the transverse directions X1, X2 and the straight line E2 that passes through the center of the second slot S2 in the transverse directions X1, X2. The controller 31 causes the work machine 1 to travel in reverse along the path PA17. Consequently, as illustrated in FIG. 25, the work machine 1 moves from the position PO17 to the position PO18.

The controller 31 determines the path PA18 that extends from a position PO18 to a position PO19, the path PA19 that extends from the position PO19 to a position PO20, and the path PA20 that extends from the position PO20 to a position PO21. The position PO19 is the position of the first coordinate point O1 when all of the crawler belts 16 are located forward of the starting edge of the slot S2. The position PO19 is a position where the work machine 1 is able to turn in a stable manner. The work machine 1 does not necessarily need to return to the position P018 and may travel in reverse to the position PO19 in the path PA17. Alternatively, the controller 31 may determine a reaching position in reverse on the path PA17 based on the position of the next reference point. The position PO20 is a position spaced away from the second reference point B2 in the first reverse direction Y2 by a distance L16 and on the straight line E1 that passes through the center in the transverse directions X1, X2 of the first slot S1. The position PO21 is a position spaced away from the second reference point B2 by a distance L17 in the first work direction Y1 on the straight line E1. The distances L16 and L17 may respectively be the same as the above-mentioned distances L2 and L3 respectively.

Figure 26:
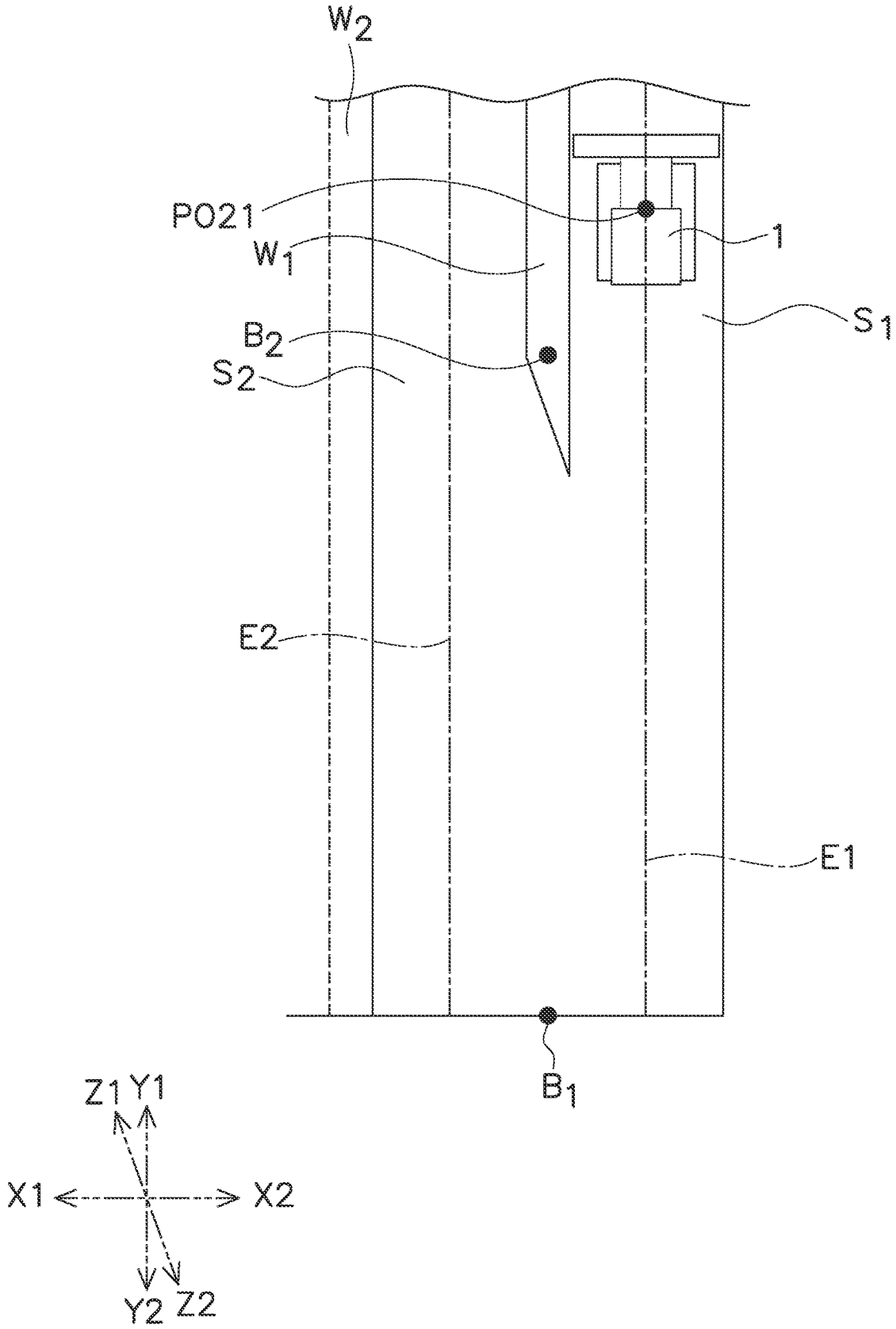
FIG. 26 illustrates the fourth travel path.

The controller 31 causes the work machine 1 to travel forward along the paths PA18, PA19, and PA20. Consequently, the work machine 1 moves from the position PO19 to the position P021 through the position PO20 as illustrated in FIG. 26. Thereafter, the controller 31 causes the work machine 1 to travel along the same paths as the above-mentioned paths PA4 to PA6. As a result, the work machine 1 moves to the next first starting position of the first excavation path based on the second reference point B2.

The controller 31 then executes the same processing as the above-mentioned steps S203-S208 based on the second reference point B2. Consequently, the controller 31 causes the work machine 1 to travel along the first excavation path and the second excavation path based on the second reference point B2 in the same way as the first reference point B1, thereby excavating the first excavation wall W1. The work machine 1 moves in accordance with the transportation path based on the second reference point B2.

The controller 31 repeats the above-mentioned processing for all of the reference points B1 to B4 on the first excavation wall W1. Consequently, the first excavation wall W1 is excavated. The controller 31 excavates the third slot S3 when the processing on the final reference point B4 on the first excavation wall W1 is completed. Processing that is the same as the above-mentioned processing of the first excavation wall W1 is executed on the second excavation wall W2 formed between the third slot S3 and the second slot S2. As a result, the second excavation wall W2 is excavated. The controller 31 repeats the same processing on the remaining slot S4 and the excavation wall W3. Consequently, the excavation of all the slots S1 to S4 and the excavation walls W1 to W3 is completed in the work range 100.

The above-mentioned distances L1 to L17 may be variable. For example, the distances L1 to L17 may be changed in accordance with an operation on the input device 35 by the operator.

In the control system and control method of the work machine 1 according to the present embodiment explained above, the work machine 1 excavates the first excavation wall W1 by moving in accordance with the first excavation path PA7. Thereafter, the work machine 1 carries the pile of soil H1 excavated from the first excavation wall W1 to the soil unloading position D2 by moving according to the transportation path PA16. The transportation path PA16 extends from a position behind the first target position G1, along the second slot S2, to the soil unloading position D2. As a result, the work machine 1 places the pile of soil H1 excavated from the first excavation wall W1 at the first target position G1 and thereafter turns without having a load applied thereto and moves to the third starting position F3 of the transportation path that is positioned behind the first target position G1. Thereafter, the work machine 1 moves to the soil unloading position D2 according to the transportation path PA16. Because the work machine 1 does not turn while carrying the pile of soil H1, the load on the work machine 1 is reduced and the quality of the finish of the work is improved in the work for removing the first excavation wall W1.

Additionally, the work machine 1 carries the piles of soil H1 and H2 along the transportation path PA16 after excavating according to the first excavation path PA7 and excavating according to the second excavation path PA12. As a result, the load on the work machine 1 is reduced in each excavation. Consequently, deviation in the movement direction of the work machine 1 during excavation during automatic control is suppressed.

The excavation wall W2 that has not been excavated is positioned in the movement direction of the work machine 1 when excavating according to the excavation paths PA7 and PA12. As a result, overflow of the soil from the sides of the blade 18 is suppressed during excavation. Additionally, the excavation walls W1 and W2 are positioned on both sides of the work machine 1 during transportation. Consequently, the overflow of the soil from the sides of the blade 18 is suppressed during transportation. Consequently, the quality of work is improved.

Although an embodiment of the present invention has been described so far, the present invention is not limited to the above embodiment and various modifications may be made within the scope of the invention. The work machine 1 is not limited to a bulldozer, and may be another type of machine such as a wheel loader. The travel device 12 is not limited to crawler belts and may include tires. The work machine 1 may be a vehicle that can be remotely operated. In this case, the operating cabin can be omitted from the work machine 1.

Figure 27:
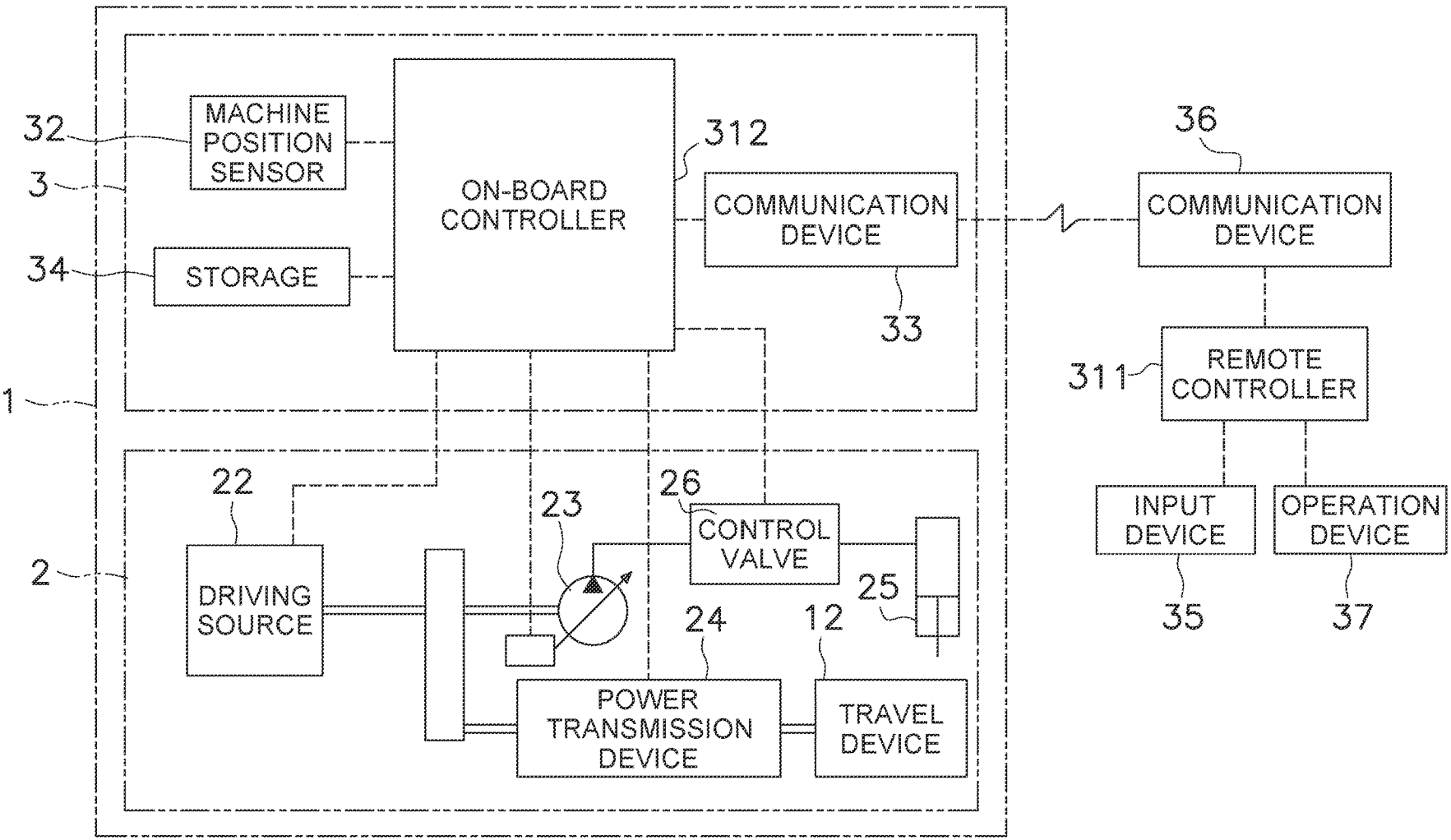
FIG. 27 is a block diagram illustrating configurations of a drive system and a control system of the work machine according to another embodiment.

A portion of the control system 3 may be disposed outside of the work machine 1. For example, the controller 31 may have a plurality of controllers separate from each other: For example as illustrated in FIG. 27, the controller 31 may include a remote controller 311 disposed outside of the work machine 1 and an on-board controller 312 mounted on the work machine 1. The remote controller 311 and the on-board controller 312 may be able to communicate wirelessly via communication devices 33 and 36. A portion of the functions of the above-mentioned controller 31 may be executed by the remote controller 311 and the remaining functions may be executed by the on-board controller 312. For example, the processing for determining the travel paths may be performed by the remote controller 311, and the processing for actuating the work machine 1 may be performed by the on-board controller 312.

The automatic control of the work machine 1 may be a semi-automatic control that is performed in accompaniment to manual operations by an operator. Alternatively, the automatic control may be a fully automatic control that is performed without manual operations by an operator. For example as illustrated in FIG. 27, the work machine 1 may be operated by an operator operating an operating device 37 disposed outside of the work machine 1.

Figure 28:
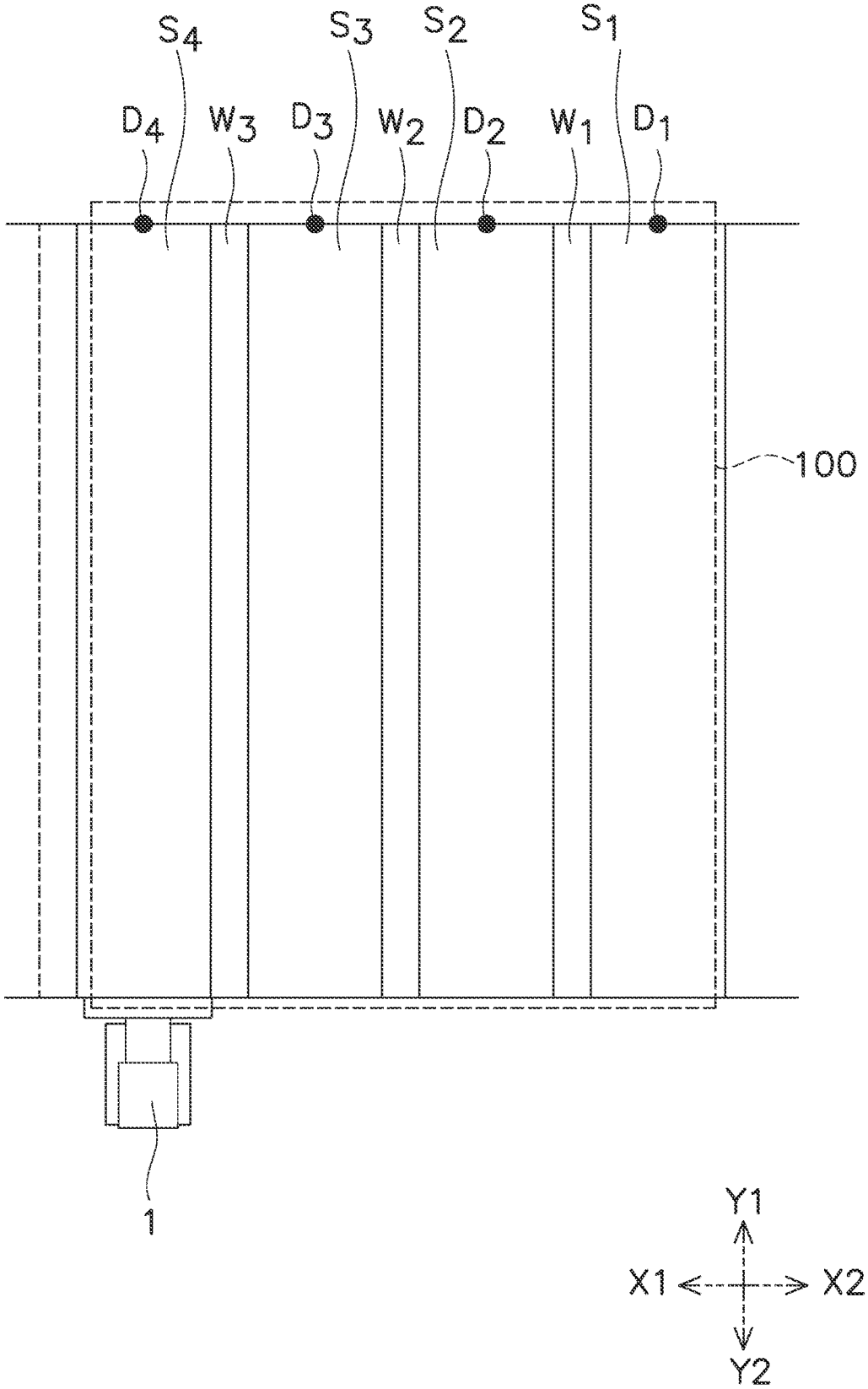
FIG. 28 illustrates work procedures based on automatic control of the work machine according to a modified example.

The processing for excavating the excavation walls is not limited to the above processing and may be changed. For example, a portion of the above processing may be changed or omitted. Processing different from the above processing may be added to the processing for excavating the excavation walls. For example, the order of excavating the slots and the excavation walls is not limited to the above embodiment and may be changed. FIG. 28 illustrates a work procedure based on automatic control of the work machine 1 according to a modified example.

As illustrated in FIG. 28, the controller 31 may excavate the first to fourth slots S1 to S4 in order. Thereafter, the controller 31 may excavate in order of the third excavation wall W3, the second excavation wall W2, and the first excavation wall W1. In this case, the controller 31 may determine the travel paths, the excavation paths, and the transportation paths so that the above-mentioned travel paths, excavation paths, and transportation paths are reversed in the transverse directions X1, X2. Other processing in the modified example is approximately the same as the above-mentioned embodiment.

The number of slots is not limited to four. The number of the slots may be less than four or may be greater than four. The number of excavation walls is not limited to three. The number of the excavation walls may be less than three or may be greater than three.

In the above embodiment, the controller 31 causes the work machine 1 to transport soil by the transportation path PA16 after excavating twice by the first excavation path PA7 and the second excavation path PA12. However, the controller 31 may cause the work machine 1 to transport soil by the transportation path PA16 after two or more excavations. Alternatively, the controller 31 may cause the work machine 1 to transport soil by the transportation path PA16 after excavating once.

In the above embodiment, the controller 31 causes the work machine 1 to move so that the first coordinate point O1 included in the vehicle body 11 follows the first to fourth travel paths. The controller 31 also causes the work machine 1 to move so that the second coordinate point O2 included in the blade 18 follows the first and second excavation paths and the transportation path. That is, the controller 31 causes the work machine 1 to move based on the second coordinate point O2 included in the blade 18 when a load is applied to the blade 18 due to excavation or transportation. Conversely, the controller 31 causes the work machine 1 to move based on the first coordinate point O1 included in the vehicle body 11 when no load is applied to the blade 18 due to excavation or transportation. However, the coordinate points based on when the work machine 1 is being moved are not limited to the above embodiment and may be changed. For example, the controller 31 may cause the work machine 1 to move so that the second coordinate point O2 follows the first to fourth travel paths.

According to the present disclosure, the load on the work machine is reduced and the quality of the finish of the work is improved in the work for removing the excavation walls.

The invention claimed is:

1. A system for controlling a work machine, the system comprising:

a machine position sensor that outputs current position data indicative of a position of the work machine; and a controller programmed to acquire the current position data, acquire topography data including a position of a first slot extending in a work direction, a position of a second slot positioned beside the first slot and extending in the work direction, and a position of a first excavation wall positioned between the first slot and the second slot and extending in the work direction, the first slot, the second slot, and the first excavation wall being disposed adjacent one another in a transverse direction that intersects the work direction, determine a first excavation path extending from the first slot to a first position on the second slot and cutting across the first excavation wall, determine a transportation path extending from behind the first position in the work direction, along the second slot, and toward a soil unloading position, and control the work machine to move in accordance with the first excavation path to excavate the first excavation wall and form a pile of soil in the second slot, and control the work machine to move in accordance with the transportation path to transport the pile of soil to the soil unloading position.

2. The system according to claim 1, wherein the controller is further programmed to determine a second excavation path extending from the first slot to a second position on the second slot, and cutting across the first excavation wall, and determine the transportation path so as to pass through the first position and the second position.

3. The system according to claim 2, wherein the second excavation path is positioned forward of the first excavation path in the work direction.

4. The system according to claim 2, wherein the controller is further programmed to cause the work machine to move in accordance with the second excavation path after causing the work machine to move in accordance with the first excavation path.

5. The system according to claim 4, wherein the first excavation path includes a third position on the first slot, the second excavation path includes a fourth position on the first slot, and the controller is further programmed to cause the work machine to move from the third position to the first position in accordance with the first excavation path and excavate the first excavation wall, cause the work machine to move from the first position to the fourth position, and cause the work machine to move from the fourth position to the second position in accordance with the second excavation path and excavate the first excavation wall.

6. The system according to claim 2, wherein the controller is further programmed to cause the work machine to move in accordance with the transportation path after causing the work machine to move in accordance with a plurality of excavation paths including the first excavation path and the second excavation path.

7. The system according to claim 2, wherein the work machine includes a work implement for excavating, and a movement range of the work implement in accordance with the second excavation path partially overlaps a movement range of the work implement in accordance with the first excavation path.

8. The system according to claim 1, wherein the work machine includes a work implement for excavating, and the controller is further programmed to control the work machine so that a coordinate point included on the work implement follows the first excavation path and the transportation path.

9. The system according to claim 1, wherein the controller is further programmed to determine a plurality of reference points disposed in predetermined distances on the first excavation wall, and determine a plurality of excavation paths including the first excavation path based on each of the plurality of reference points.

10. The system according to claim 1, wherein the topography data includes a position of a third slot positioned beside the second slot, and a position of a second excavation wall positioned between the second slot and the third slot, and the controller is further programmed to control the work machine to excavate in order of the first slot, the second slot, the first excavation wall, the third slot, and the second excavation wall.

11. A method for controlling a work machine, the method comprising using a machine position sensor that outputs current position data indicative of a position of the work machine and a controller that is operatively coupled to the machine position sensor and programmed to control the work machine to execute the steps of:

acquiring current position data indicative of a position of the work machine;

acquiring topography data including a position of a first slot extending in a work direction, a position of a second slot positioned beside the first slot and extending in the work direction, and a position of a first excavation wall positioned between the first slot and the second slot and extending in the work direction, the first slot, the second slot, and the first excavation wall being disposed adjacent one another in a transverse direction that intersects the work direction;

determining a first excavation path extending from the first slot to a first position on the second slot, and cutting across the first excavation wall;

determining a transportation path extending from a position behind the first position in the work direction, along the second slot, and toward a soil unloading position;

controlling the work machine to move in accordance with the first excavation path to excavate the first excavation wall and form a pile of soil in the second slot; and control the work machine to move in accordance with the transportation path to transport the pile of soil to the soil unloading position.

12. The method according to claim 11, further comprising determining a second excavation path extending from the first slot to a second position on the second slot, and cutting across the first excavation wall; and determining the transportation path so as to pass through the first position and the second position.

13. The method according to claim 12, wherein the second excavation path is positioned forward of the first excavation path in the work direction.

14. The method according to claim 12, further comprising causing the work machine to move in accordance with the second excavation path after causing the work machine to move in accordance with the first excavation path.

15. The method according to claim 14, wherein the first excavation path includes a third position on the first slot, the second excavation path includes a fourth position on the first slot, and the method further comprises causing the work machine to move from the third position to the first position in accordance with the firth excavation path and excavate the first excavation wall, causing the work machine to move from the first position to the fourth position, and causing the work machine to move from the fourth position to the second position in accordance with the second excavation path and excavate the first excavation wall.

16. The method according to claim 12, further comprising causing the work machine to move in accordance with the transportation path after causing the work machine to move in accordance with a plurality of excavation paths including the first excavation path and the second excavation path.

17. The method according to claim 12, wherein the work machine includes a work implement for excavating, and the method further comprises a movement range of the work implement in accordance with the second excavation path partially overlapping a movement range of the work implement in accordance with the first excavation path.

18. The method according to claim 11, wherein the work machine includes a work implement for excavating, and the method further comprises controlling the work machine so that a coordinate point included on the work implement follows the first excavation path and the transportation path.

19. The method according to claim 11, further comprising determining a plurality of reference points disposed in predetermined distances on the first excavation wall, and determining a plurality of excavation paths including the first excavation path based on each of the plurality of reference points.

20. The method according to claim 11, wherein the topography data includes a position of a third slot positioned beside the second slot, and a position of a second excavation wall positioned between the second slot and the third slot, and the method further comprises controlling the work machine to excavate in order of the first slot, the second slot, the first excavation wall, the third slot, and the second excavation wall.

* * * * *